US006593075B1

(12) United States Patent
Ichikawa et al.

(10) Patent No.: US 6,593,075 B1
(45) Date of Patent: Jul. 15, 2003

(54) SILVER HALIDE PHOTOGRAPHIC LIGHT-SENSITIVE MATERIAL

(75) Inventors: Shinichi Ichikawa, Kanagawa (JP); Takeshi Suzumoto, Kanagawa (JP); Kohzaburoh Yamada, Kanagawa (JP); Tadashi Inaba, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/624,968

(22) Filed: Jul. 24, 2000

(30) Foreign Application Priority Data

Jul. 27, 1999 (JP) ..... 11-212393

(51) Int. Cl.[7] ..... G03C 1/06

(52) U.S. Cl. ..... 430/603; 430/600; 430/607; 430/611; 430/613; 430/551; 430/567; 430/583; 430/584; 430/588

(58) Field of Search ..... 430/600, 603, 430/607, 611, 613, 551, 567, 583, 584, 588

(56) References Cited

U.S. PATENT DOCUMENTS 5,747,235 A * 5/1998 Farid et al. ..... 430/583
5,747,236 A * 5/1998 Farid et al. ..... 430/583
5,994,051 A * 11/1999 Gould et al. ..... 430/588
6,054,260 A * 4/2000 Adin et al. ..... 430/583

* cited by examiner

*Primary Examiner*—Geraldine Letscher
(74) *Attorney, Agent, or Firm*—Sughrue Mion, PLLC

(57) ABSTRACT

A silver halide photographic light-sensitive material having at least one emulsion layer comprising silver halide grains, with the emulsion layer further comprising at least one compound represented by the following formula (I) and at least one compound represented by the following formula (II), (III), (IV-1), (IV-2), (V-1), (V-2), (V-3) or (VI):

$$(X)_l\text{—}(L)_m\text{—}(A\text{—}B)_n \quad \text{(I)}$$

(II)

$$(Het)_{k1}\text{—}[(Q_1)_{k2}\text{—}(Hy)]_{k3} \quad \text{(III)}$$

(IV-1)

(IV-2)

(V-1)

(V-2)

(V-3)

(VI)

wherein the substituents as defined herein the specification.

12 Claims, No Drawings

SILVER HALIDE PHOTOGRAPHIC LIGHT-SENSITIVE MATERIAL

FIELD OF THE INVENTION

The present invention relates to a silver halide photographic light-sensitive material. Specifically, the invention is concerned with a silver halide photographic light-sensitive material which, though it has an increased photographic sensitivity, is improved in not only fog caused by increasing the photographic sensitivity but also storage fog arising from storage under severe conditions.

BACKGROUND OF THE INVENTION

In order to increase the intrinsic sensitivity of silver halide, a wide variety of methods have been adopted. For instance, the sensitivity increase is achieved by the use of chemical sensitizers, such as sulfur compounds, gold compounds and compounds of the group VIII metals, the combined use of those chemical sensitizers and additives enhancing their sensitizing effects, or the addition of additives capable of producing sensitizing effects depending on the species of a silver halide emulsion. Further, the sensitization techniques using organic electron donating compounds in which both electron donating group and releasing group are present are reported in U.S. Pat. Nos. 5,747,235 and 5,747,236, EP-A-786692, EP-A-893731, EP-A-893732 and WO99/05570. On the other hand, the fog accompanying a sensitivity increase and the storage fog arising from the storage under severe conditions, e.g., under circumstances of high temperature and high humidity, or in atmospheres of harmful gases produced by combustion, such as automobile exhaust gases, become problems. As compounds usable for inhibiting the fog generation, there are known mercaptotetrazoles, tetraazaindenes and the salts of thiosulfonic acid (*Research Disclosure*, Item 36544 (vol. 365, September in 1994), Section IV). The compounds recited above are however insufficient to inhibit the fog from generating with an increase of sensitivity, or conversely result in interference on the sensitivity increase. In other words, their effects are unsatisfactory. In addition, those compounds have little effects on the storage fog which generates upon storage under severe conditions, e.g., under circumstances of high temperature and high humidity, or in atmospheres of harmful gases produced by combustion, such as automobile exhaust gases. Therefore, it becomes an important subject to achieve the inhibition of the fog generation accompanying an sensitivity increase and the control of the storage fog. As other means for inhibiting the fog generation while increasing the sensitivity, the following are known.

As one means, it has been reported to combine certain sensitizers with organic compounds in themselves having very little or no sensitizing effect, thereby achieving both sensitization effect and storage stability. As examples of such a case are reported the chemical sensitization in the presence of 6-hydroxypurine in JP-B-7-11684 (the term "JP-B" as used herein means an "examined Japanese patent publication") the combinations of tellurium sensitizers with polymeric thioethers in JP-A-6-59362 (the term "JP-A" as used herein means an "unexamined published Japanese patent application"), the combinations of selenium sensitizers with hydrazine compounds in JP-A-6-19035 and JP-A-6-202262, and the combinations of tellurium sensitizers with hydrazine compounds in JP-A-5-333469.

As another means, the compounds which in themselves has no function as a sensitizer but can increase the sensitivity and control the fog generation when added to a silver halide emulsion layer have been reported.

Examples of such compounds include the thioether compounds disclosed in JP-B-6-56473, JP-A-1-12184, JP-A-1-121846, JP-B-7-11684 and Registered Japanese Patent No. 2,604,240, ascorbic acid the derivatives thereof as disclosed in Registered Japanese Patent Nos. 2,505,262 and 2,578,188, the silver halide adsorbing hydroquinone compounds disclosed in Registered Japanese Patent No. 2,641,982, the mercapto compounds disclosed in JP-A-5-134345, the benzothiazolium salts and thiosulfonic acids disclosed in JP-A-6-161019, and the thiourea dioxide compounds disclosed in JP-A-7-92591. Even when these compounds are used, however, the sensitization effects obtained are small, and the storage fog and the fog generation accompanying a sensitivity increase are not inhibited to a satisfactory extent.

SUMMARY OF THE INVENTION

Therefore, an object of the invention is to provide a silver halide photographic emulsion having improved sensitivity and keeping quality and, more specifically, to provide a silver halide photographic light-sensitive material which has an increased photographic sensitivity but control fog generation accompanying the increase in photographic sensitivity and has reduced storage fog even when stored under severe conditions, such as under circumstances of high temperature and high humidity, or in atmospheres of harmful gases generating upon combustion, such as automobile exhaust gases.

The object mentioned above is attained with a silver halide photographic light-sensitive material having a silver halide emulsion layer that is chemically sensitized by an organic electron-donating compound and improved in storage properties by containing a weakly reducing compound.

More specifically, the following are embodiments of the invention:

1. A silver halide photographic light-sensitive material having at least one emulsion layer comprising silver halide grains, with the emulsion layer further comprising at least one compound represented by the following formula (I) and at least one compound represented by the following formula (II), (III), (IV-1), (IV-2), (V-1), (V-2), (V-3) or (VI):

$$(X)_l\text{—}(L)_m\text{—}(A\text{—}B)_n \qquad \text{(I)}$$

wherein X represents a silver halide adsorbing group containing at least one N, S, P, Se or Te atom, or a light absorbing group; L represents a divalent linkage group comprising at least one C, N, S or O atom; A represents an electron donating group; B represents a releasing group; 1 and m each represents 0, 1, 2 or 3; and n represents 1 or 2;

(II)

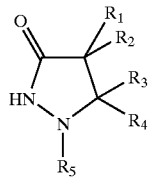

wherein $R_1$, $R_2$, $R_3$ and $R_4$, which are independent of each other, each represents a hydrogen atom, an aryl group, a chain or cyclic alkyl group, a chain or cyclic alkenyl group, or an alkynyl group; and $R_5$ represents a chain or cyclic alkyl group, a chain or cyclic alkenyl group, an alkynyl group, an aryl group or a heterocyclic group;

$$(Het)_{k1}-[(Q_1)_{k2}-(Hy)]_{k3} \quad (III)$$

wherein Het represents a group enabling the adsorption to silver halide grains; $Q_1$ represents a divalent linkage group made up of an atom or atomic group comprising at least one carbon, nitrogen, sulfur or oxygen atom; Hy represents a group having a hydrazine structure represented by $R_6R_7N—NR_8R_9$; $R_6$, $R_7$, $R_8$ and $R_9$, which are independent of each other, each represents an alkyl group, an alkenyl group, an alkynyl group, an aryl group or a heterocyclic group, or $R_6$ and $R_7$, $R_8$ and $R_9$, $R_6$ and $R_8$, or $R_7$ and $R_9$ may combine with each other to complete a ring, provided that at least one among $R_6$, $R_7$, $R_8$ and $R_9$ is an alkylene group, an alkenylene group, an alkynylene group, an arylene group or a divalent heterocyclic ring residue to which $—(Q_1)_{k2}(Het)_{k1}$ is attached; k1 and k3 each represents 1, 2, 3 or 4; and k2 represents 0 or 1;

(IV-1)

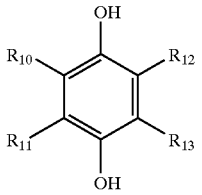

(IV-2)

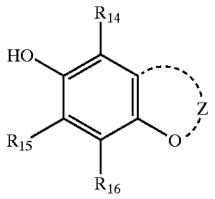

wherein $R_{10}$, $R_{11}$, $R_{12}$ and $R_{13}$, which are independent of each other, each represents a hydrogen atom or a substituent group, provided that, when the substituent groups represented by $R_{10}$ and $R_{13}$ or those represented by $R_{11}$ and $R_{12}$ are both alkyl groups, the number of carbon atoms contained in one alkyl group is different from that in the other; $R_{14}$, $R_{15}$ and $R_{16}$, which are independent of each other, each represents a hydrogen atom or a substituent group; and Z represents nonmetal atoms completing a 4- to 6-membered ring;

(V-1)

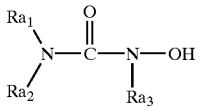

(V-2)

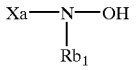

(V-3)

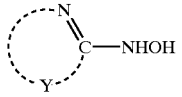

wherein $Ra_1$ represents a substituted or unsubstituted alkyl group, an alkenyl group or an aryl group, $Ra_2$ represents a hydrogen atom or a group represented by $Ra_1$, and $Ra_3$ represents a hydrogen atom, a substituted or unsubstituted alkyl group containing 1 to 10 carbon atoms or a substituted or unsubstituted alkenyl group containing 1 to 10 carbon atoms, or any two of $Ra_1$, $Ra_2$ and $Ra_3$ combine with each other to complete a 5- to 7-membered ring; Xa represents a heterocyclic group and $Rb_1$ represents an alkyl group, an alkenyl group or an aryl group, or Xa and $Rb_1$ combine with each other to complete a 5- to 7-membered ring; Y represents nonmetal atoms forming a 5-membered ring in combination with the —N═C— moiety, or nonmetal atoms forming a 6-membered ring in combination with the —N═C— moiety wherein the end group of Y bonded to the carbon atom of the —N═C— moiety is a group selected from the class consisting of $—N(Rc_1)—$, $—C(Rc_2)(Rc_3)—$, $—C(Rc_4)═$, —O— and —S— (which are each bonded to the carbon atom of —N═C— on the left side); and $Rc_1$ to $Rc_4$, which are independent of each other, each represents a hydrogen atom or a substitutent group;

(VI)

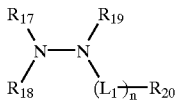

wherein $R_{17}$, $R_{18}$ and $R_{19}$, which are independent of each other, each represents a hydrogen atom, an alkyl group, an alkenyl group, an aryl group or a heterocyclic group, $R_{20}$ represents a hydrogen atom, an alkyl group, an alkenyl group, an alkynyl group, an aryl group, a heterocyclic group or $—NR_{21}R_{22}$, $L_1$ represents —CO— or $—SO_2—$, n represents 0 or 1, $R_{21}$ represents a hydrogen atom, a hydroxyl group, an amino group, an alkyl group, an alkenyl group, an alkynyl group, an aromatic group or a heterocyclic group, $R_{22}$ represents an alkyl group, an alkenyl group, an alkynyl group, an aromatic group or a heterocyclic group, or $R_{17}$ and $R_{18}$, $R_{17}$ and $R_{19}$, $R_{19}$ and $R_{20}$, or $R_{20}$ and $R_{18}$ combine with each other to complete a ring.

2. A silver halide photographic light-sensitive material as described in Embodiment 1, wherein the silver halide grains are sensitized by a compound represented by formula (I).

3. A silver halide photographic light-sensitive material as described in Embodiment 1, wherein the compound represented by formula (I) has an oxidation potential of from 0 to 1.5 V.

4. A silver halide photographic light-sensitive material as described in Embodiment 1, wherein the moiety A—B in the compound represented by formula (I), when it takes an oxidation form, undergoes bond cleavage reaction to produce a radical A. having an oxidation potential of −0.6 V or below and a releasing fragment B.

5. A silver halide photographic light-sensitive material as described in Embodiment 1 or 2, wherein at least 60% of the silver halide grains in said at least one emulsion layer on a projected area basis are tabular silver halide grains having an aspect ratio of at least 8.

DETAILED DESCRIPTION OF THE INVENTION

The compounds used in the present invention are illustrated below in detail.

The silver halide adsorbing group represented by X in formula (I) contains at least one N, S, P, Se or Te atom, and preferably has a silver ion ligand structure. Suitable examples of a group having such a silver ion ligand structure include groups represented by the following formulae (X-1), (X-2a), (X-2b), (X-3), (X-4), (X-5a), (X-5b), (X-6a) and (X-6b) respectively. Additionally, it is desirable that the pKa of the compounds as recited below be from 3 to 14.

$$—G_1—Z_1—R_{23} \quad \text{(X-1)}$$

wherein $G_1$ represents a divalent linkage group, with examples including a substituted or unsubstituted alkylene group, a substituted or unsubstituted alkenylene group, a substituted or unsubstituted alkynylene group, a substituted or unsubstituted arylene group, a substituted or unsubstituted sulfonyl group and a substituted or unsubstituted divalent heterocyclic group; $Z_1$ represents an S, Se or Te atom; and $R_{23}$ represents a hydrogen atom, or a sodium, potassium, lithium or ammonium ion as a counter ion necessitated when $Z_1$ has a dissociation form;

(X-2a)

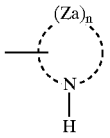

(X-2b)

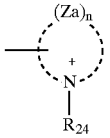

wherein a 5- to 7-membered heterocyclic or unsaturated ring is formed, Za represents an O, N, S, Se or Te atom, n represents 0, 1, 2 or 3, and $R_{24}$ represents a hydrogen atom, an alkyl group, an alkenyl group, an alkynyl group or an aryl group;

$$—R_{25}—(Z_2)_n—R_{26} \quad \text{(X-3)}$$

wherein $Z_2$ represents an S, Se or Te atom, n represents 1, 2 or 3, $R_{25}$ represents an alkylene group, an alkenylene group, an alkynylene group, an arylene group or a divalent heterocyclic group, and $R_{26}$ represents an alkyl group, an aryl group or a heterocyclic group;

(X-4)

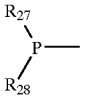

wherein $R_{27}$ and $R_{28}$, which are independent of each other, each represents an alkyl group, an alkenyl group, an aryl group or a heterocyclic grouop;

(X-5a)

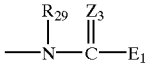

(X-5b)

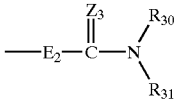

wherein $Z_3$ represents an S, Se or Te atom; $E_1$ represents a hydrogen atom, $NH_2$, $NHR_{31}$, $N(R_{32})_2$, $NHN(R_{32})_2$, $OR_{32}$ or $SR_{32}$; $E_2$ represents NH, $NR_{32}$, $NHNR_{32}$, O or S; $R_{29}$, $R_{30}$ and $R_{31}$, which are independent of each other, each represents a hydrogen atom, an alkyl group, an alkenyl group, an aryl group or a heterocyclic group, or $R_{30}$ and $R_{31}$ combine with each other to complete a ring; and $R_{32}$ represents a hydrogen atom, an alkyl group, an alkenyl group, an aryl group or a heterocyclic group;

(X-6a)

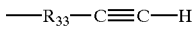

(X-6b)

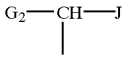

wherein $R_{33}$ represents a divalent linkage group, including an alkylene group, an alkenylene group, an alkynylene group, an arylene group and a divalent heterocyclic group; $G_2$ and J, which are independent of each other, each represents $COOR_{34}$, $SO_2R_{34}$, $COR_{34}$, $SOR_{34}$, CN, CHO or $NO_2$; and $R_{34}$ represents an alkyl group, an alkenyl group or an aryl group.

The groups represented by formula (X-1) are described in more detail. As examples of a linkage group represented by $G_1$, mention may be made of a substituted or unsubstituted straight-chain or branched alkylene group containing 1 to 20 carbon atoms (such as methylene, ethylene, trimethylene, isopropylene, tetramethylene, hexamethylene, 3-oxapentylene or 2-hydroxytrimethylene), a substituted or unsubstituted cycloalkylene group containing 3 to 18 carbon atoms (such as cyclopropylene, cyclopentylene or cyclohexylene), a substituted or unsubstituted alkenylene group containing 2 to 20 carbon atoms (such as ethenylene or 2-butenylene), an alkynylene group containing 2 to 10 carbon atoms (such as ethynylene) and a substituted or unsubstituted arylene group containing 6 to 20 carbon atoms (such as unsubstituted p-phenylene or unsubstituted 2,5-naphthylene group).

Examples of a sulfonyl group represented by $G_1$ include $—SO_2—$ groups to which a substituted or unsubstituted straight-chain or branched alkylene group containing 1 to 10 carbon atom, a substituted or unsubstituted cyclic alkylene group containing 3 to 6 carbon atoms and a substituted or unsubstituted straight-chain or branched alkenylene group containing 2 to 10 carbon atoms are attached respectively.

Examples of a divalent heterocyclic group represented by $G_1$ include a divalent unsubstituted heterocyclic group, a heterocyclic group substituted by an alkylene group, an alkenylene group, arylene group or a divalent heterocyclic group, and a benzene ring-condensed or naphthalene ring-condensed divalent heterocyclic group. (As examples of a heterocyclic group contained in the substituted or ring-condensed group as recited above, mention may be made of 1,5-tetrazole-diyl, 3,5-triazole-diyl, 1,2-imidazole-diyl, 2,5-oxadiazole-diyl, 2,4-thiazole-diyl, 2,6-benzimidazole-diyl, 2,6-benzothiazole-diyl, 2,6-benzoxazole-diyl, 2,4-pyrimidine-diyl, 1,5-(3-phenyltetrazole)-diyl, 3,5-pyridine-diyl, 3,4-furan-diyl, 2,5-piperidine-diyl and 2,5-morpholine-diyl groups.)

$G_1$ in formula (X-1) may have all possible substituent groups. Examples of such substituent groups are recited below Herein, each of them is referred to as substituent Y.

More specifically, examples of Y includes a halogen atom (such as fluorine, chlorine or bromine atom), an alkyl group (e.g., methyl, ethyl, isopropyl, n-propyl or t-butyl), an alkenyl group (such as allyl or 2-butenyl), an alkynyl group (such as propargyl), an aralkyl group (such as benzyl), an aryl group (such as phenyl, naphthyl or 4-methylphenyl), a heterocyclic group (such as pyridyl, furyl, imidazolyl, piperidyl or morpholinyl), an alkoxy group (such as methoxy, ethoxy, butoxy, 2-ethylhexyloxy, ethoxyethoxy or methoxyethoxy), an aryloxy group (such as phenoxy or 2-naphthyloxy), an amino group (such as unsubstituted amino, dimethylamino, diethylamino, dipropylamino, dibutylamino, ethylamino or anilino), an acylamino group (such as acetylamino or benzoylamino), an ureido group (such as unsubstituted ureido or N-methylureido), an urethane group (such as methoxycarbonylamino or phenoxycarbonylamino), a sulfonyl-amino group (such as methylsulfonylamino or phenyl-sulfonylamino), a sulfamoyl group (such as unsubstituted sulfamoyl, N,N-dimethylsulfamoyl or N-phenylsulfamoyl), a carbamoyl group (such as unsubstituted carbamoyl, N,N-diethylcarbamoyl or N-phenylcarbamoyl), a sulfonyl group (such as mesyl or tosyl), a sulfinyl group (such as methylsulfinyl or phenylsulfinyl), an alkyloxycarbonyl group (such as methoxycarbonyl or ethoxycarbonyl), an aryloxycarbonyl group (such as phenoxycarbonyl), an acyl group (such as acetyl, benzoyl, formyl or pivaroyl), an acyloxy group (such as acetoxy or benzoyloxy), a phosphamido group (such as N,N-diethylphosphamido), a cyano group, a sulfo group, a thiosulfonic acid group, a sulfinic acid group, a carboxyl group, a hydroxyl group, a phosphono group, a nitro group, an ammonio group, a phosphonio group, a hydrazino group and a thiazolino group. When $G_1$ has two or more substituents, they may be the same or different. And the substituents as recited above may further be substituted by another group.

Desirable examples of a silver halide adsorbing group of formula (X-1) are described below.

The groups desirable for $G_1$ in formula (X-1) are a substituted or unsubstituted arylene group containing 6 to 10 carbon atoms and an unsubstituted, alkylene or arylene-attached, or benzene or naphthalene ring-condensed 5 to 7-membered heterocyclic group. The atoms desirable for $Z_1$ are S and Se atoms. As to $R_{23}$, hydrogen atom, sodium ion and potassium ion are desirable.

It is more desirable for $G_1$ to be a substituted or unsubstituted arylene group containing 6 to 8 carbon atoms or an arylene-attached or benzene ring-condensed 5- or 6-membered heterocyclic group. The most desirable $G_1$ is an arylene-attached or benzene ring-condensed 5- or 6-membered heterocyclic group. The preferred $Z_1$ is S, and the preferred $R_{23}$ is a hydrogen atom or sodium ion.

Formulae (X-2a) and (X-2b) are illustrated below in detail.

Examples of an alkyl, alkenyl or alkynyl group represented by $R_{24}$ include substituted or unsubstituted straight-chain or branched alkyl groups containing 1 to 10 carbon atoms (such as methyl, ethyl, isopropyl, n-propyl, n-butyl, t-butyl, 2-pentyl, n-hexyl, n-octyl, t-octyl, 2-ethylhexyl, 2-hydroxyethyl, 1-hydroxyethyl, diethylaminoethyl, n-butoxypropyl or methoxymethyl), substituted or unsubstituted cyclic alkyl groups containing 3 to 6 carbon atoms (such as cyclopropyl, cyclopentyl or cyclohexyl), alkenyl groups containing 2 to 10 carbon atoms (such as allyl, 2-butenyl or 3-pentenyl), alkynyl groups containing 2 to 10 carbon atoms (such as propargyl or 3-pentynyl) and aralkyl groups containing 6 to 12 carbon atoms (such as benzyl). Examples of an aryl group as $R_{24}$ include substituted or unsubstituted aryl groups containing 6 to 12 carbon atoms (such as unsubstituted phenyl or 4-methylphenol).

Each of the groups recited above as $R_{24}$ may further have a substituent Y.

Of the groups represented by formulae (X-2a) and (X-2b) respectively, the following are desirable.

In each formula, it is desirable that $R_{24}$ be a hydrogen atom, a substituted or unsubstituted alkyl group containing 1 to 6 carbon atoms or a substituted or unsubstituted aryl group containing 6 to 10 carbon atoms, Za be O, N or S and n be from 1 to 3.

Preferably, $R_{24}$ is a hydrogen atom or an alkyl group containing 1 to 4 carbon atoms, Za is N or S, and n is 2 or 3.

Formula (X-3) is illustrated below in detail.

Therein, the linkage group represented by $R_{25}$ includes substituted or unsubstituted straight-chain or branched alkylene groups containing 1 to 20 carbon atoms (such as methylene, ethylene, trimethylene, isopropylene, tetramethylene, hexamethylene, 3-oxapentylene and 2-hydroxytrimethylene), substituted or unsubstituted cyclic alkylene groups containing 3 to 18 carbon atoms (such as cyclopropylene, cyclopentylene and cyclohexylene), substituted or unsubstituted alkenylene groups containing 2 to 20 carbon atoms (such as ethenylene and 2-butenylene), alkynylene groups containing 2 to 10 carbon atoms (such as ethynylene), substituted or unsubstituted arylene groups containing 6 to 20 carbon atoms (such as unsubstituted p-phenylene and unsubstituted 2,5-naphthylene) and divalent heterocyclic groups which each have no substitutent or an alkylene, alkenylene, arylene or heterocyclic substituent (such as divalent groups derived from pyridine, 3-phenylpyridine, piperidine and morpholine respectively).

In the formula, the alkyl group represented by $R_{26}$ includes substituted or unsubstituted straight-chain or branched alkyl groups containing 1 to 10 carbon atoms (such as methyl, ethyl, isopropyl, n-propyl, n-butyl, t-butyl, 2-pentyl, n-hexyl, n-octyl, t-octyl, 2-ethylhexyl, 2-hydroxyethyl, 1-hydroxyethyl, diethylaminoethyl, dibutylaminoethyl, n-butoxymethyl and methoxymethyl) and substituted or unsubstituted cycloalkyl groups containing 3 to 6 carbon atoms (such as cyclopropyl, cyclopentyl and cyclohexyl), and the aryl group as $R_{26}$ includes substituted or unsubstituted aryl groups containing 6 to 12 carbon atoms (such as unsubstituted phenyl and 2-methylphenyl).

The heterocyclic group as $R_{26}$ includes heterocyclic groups which each have no substitutent or an alkyl, alkenyl, aryl or heterocyclic substituent (such as pyridyl, 3-phenylpyridyl, piperidyl and morpholinyl).

Each of the groups as $R_{26}$ as recited above may have a substitutent Y.

Of the groups represented by formula (X-3), the following are desirable.

In the formula, it is desirable that $R_{25}$ be a substituted or unsubstituted alkylene group containing 1 to 6 carbon atoms or a substituted or unsubstituted arylene group containing 6 to 10 carbon atoms, $R_{26}$ be a substituted or unsubstituted alkyl group containing 1 to 6 carbon atoms or a substituted or unsubstituted aryl group containing 6 to 10 carbon atoms, $Z_2$ be S or Se and n be 1 or 2.

Preferably, $R_{25}$ is an alkylene group containing 1 to 4 carbon atoms, $R_{26}$ is an alkyl group containing 1 to 4 carbon atoms, $Z_2$ is S, and n is 1.

Formula (X-4) is illustrated below in detail.

Therein, the alkyl group represented by $R_{27}$ and $R_{28}$ each includes substituted or unsubstituted, straight-chain or branched alkyl groups containing 1 to 10 carbon atoms (e.g., methyl, ethyl, isopropyl, n-propyl, n-butyl, t-butyl, 2-pentyl, n-hexyl, n-octyl, t-octyl, 2-ethylhexyl, hydroxymethyl, 2-hydroxyethyl, 1-hydroxyethyl, diethylaminoethyl, dibutyl-aminoethyl, n-butoxymethyl, n-butoxypropyl, methoxymethyl) and substituted or unsubstituted cyclic alkyl groups containing 3 to 6 carbon atoms (e.g., cyclopropyl, cyclopentyl, cyclohexyl); the alkenyl group represented by $R_{27}$ and $R_{28}$ each includes alkenyl groups containing 2 to 10 carbon atoms (e.g., allyl, 2-butenyl, 3-pentenyl); the aryl group represented by $R_2$ and $R_2$ each includes substituted or unsubstituted aryl groups containing 6 to 12 carbon atoms (e.g., unsubstituted phenyl, 4-methylphenyl); and the heterocyclic group represented by $R_{27}$ and $R_{28}$ each includes heterocyclic groups which each have no substituent or an alkyl, alkenyl, aryl or heterocyclic substituent (e.g., pyridyl, 3-phenylpyridyl, furyl, piperidyl, morpholinyl).

Each of the above-recited groups as $R_{27}$ and $R_{28}$ each may further have a substitutent Y.

Of the groups represented by formula (X-4), the following are desirable

In formula (X-4), it is desirable that $R_{27}$ and $R_{28}$ each be a substituted or unsubstituted alkyl group containing 1 to 6 carbon atoms or a substituted or unsubstituted aryl group containing 6 to 10 carbon atoms, preferably an aryl group containing 6 to 8 carbon atoms.

Formulae (X-5a) and (X-5b) are illustrated below in detail.

Examples of a group represented by $E_1$ in formula (X-5a) include $NH_2$, $NHCH_3$, $NHC_2H_5$, NHPh, $N(CH_3)_2$, $N(Ph)_2$, $NHNHC_3H_7$, NHNHPh, $OC_4H_9$, OPh and $SCH_3$, and examples of a group represented by $E_2$ in formula (X-5b) include NH, $NCH_3$, $NC_2H_5$, NPh, $NHNC_3H_7$ and NHNPh.

Examples of an alkyl group and an alkenyl group represented by each of $R_{29}$, $R_{30}$ and $R_{31}$ in those formulae include substituted or unsubstituted, straight-chain or branched alkyl groups containing 1 to 10 carbon atoms (such as methyl, ethyl, isopropyl, n-propyl, n-butyl, t-butyl, 2-pentyl, n-hexyl, n-octyl, t-octyl, 2-ethylhexyl, hydroxymethyl, 2-hydroxyethyl, 1-hydroxyethyl, diethylaminoethyl, dibutylaminoethyl, n-butoxymethyl, n-butoxypropyl and methoxymethyl), substituted or unsubstituted cyclic alkyl groups containing 3 to 6 carbon atoms (such as cyclopropyl, cyclopentyl and cyclohexyl), and alkenyl groups containing 2 to 10 carbon atoms (such as allyl, 2-butenyl and 3-pentenyl). Examples of an aryl group represented by each of $R_{29}$, $R_{30}$ and $R_{31}$ in those formulae include substituted or unsubstituted aryl groups containing 6 to 12 carbon atoms (such as unsubstituted phenyl and 4-methylphenyl), and those of a heterocyclic group include heterocyclic groups which each have no substituent or an alkyl, alkenyl, aryl or heterocyclic substitutent (such as pyridyl, 3-phenylpyridyl, furyl, piperidyl and morpholinyl).

Each of $R_{29}$, $R_{30}$ and $R_{31}$ may further have a substituent Y.

Of the groups represented by formulae (X-5a) and (X-5b), the following are desirable.

In those formulae, it is desirable that $E_1$ be an alkyl-substituted or unsubstiuted amino group or an alkoxy group, $E_2$ be an alkyl-substitued or unsubstituted amino linkage, $R_{29}$, $R_{30}$ and $R_{31}$ be each a substituted or unsubstituted alkyl group containing 1 to 6 carbon atoms or a substituted or unsubstituted aryl group containing 6 to 10 carbon atoms, and $Z_3$ be S or Se.

Therein, it is more desirable that $E_1$ be an alkyl-substituted or unsubstiuted amino group, $E_2$ be an alkyl-substitued or unsubstituted amino linkage, $R_{29}$, $R_{30}$ and $R_{31}$ be each a substituted or unsubstituted alkyl group containing 1 to 4 carbon atoms and $Z_3$ be S.

Formulae (X-6a) and (X-6b) are illustrated below in detail.

Examples of a group represented by $G_2$ and J each in formula (X-6b) include $COOCH_3$, $COOC_3H_7$, $COOC_6H_{13}$, COOPh, $SO_2CH_3$, $SO_2C_4H_9$, $COC_2H_5$, COPh, $SOCH_3$, SOPh, CN, CHO and $NO_2$.

Examples of a linkage group represented by $R_{33}$ in formula (X-6a) incldue substituted or unsubstituted, straight-chain or branched alkylene groups containing 1 to 20 carbon atoms (such as methylene, ethylene, trimethylene, isopropylene, tetramethylene, hexamethylene, 3-oxapentylene and 2-hydroxytrimethylene), substituted or unsubstituted cycloalkylene groups containing 3 to 18 carbon atoms (such as cyclopropylene, cyclopentylene and cyclohexylene), substituted or unsubstituted alkenylene groups containing 2 to 20 carbon atoms (such as ethenylene and 2-butenylene), alkynylene groups containing 2 to 10 carbon atoms (such as ethynylene), and substituted or unsubstituted arylene groups containing 6 to 20 carbon atoms (such as unsubstituted p-phenylene and unsubstituted 2,5-naphthylene).

Examples of a heterocyclic group represented by $R_{33}$ in formula (X-6a) include divalent heterocyclic groups having no substituent and alkylene-, alkenylene-, arylene- or heterocyclic group-substituted divalent heterocyclic groups (such as divalent groups derived from pyridine, 3-phenylpyridine, furan, piperidine and morpholine respectively).

Each of the groups represented by $R_{33}$ may further have a substituent Y.

Of the groups represented by formulae (X-6a) and (X-6b) each, the following are desirable.

In these formulae, it is desirable that $G_2$ and J be each an esterified carboxyl residue containing 2 to 6 carbon atoms or acyl group containing 1 to 6 carbon atoms, and $R_{33}$ be a substituted or unsubstituted alkylene group containing 1 to 6 carbon atoms or a substituted or unsubstituted arylene group containing 6 to 10 carbon atoms.

Therein, it is more desirable that $G_2$ and J be each an esterified carboxyl residue containing 2 to 4 carbon atoms and $R_{33}$ be a substituted or unsubstituted alkylene group containing 1 to 4 carbon atoms or a substituted or unsubstituted arylene group containing 6 to 8 carbon atoms.

With respect to the ranking of silver halide adsorbing groups represented by X, the following is the descending order of suitability:

(X-1)>(X-2a)>(X-2b)>(X-3)>(X-5a)>(X-5b)>(X-4)>(X-6a)>(X-6b)

Next the light-absorbing group represented by X in formula (I) is illustrated in detail.

The light-absorbing group as X includes those represented by the following formula (X-7):

(X-7)

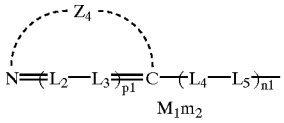

wherein $Z_4$ represents atoms completing a 5- or 6-membered nitrogen-containing hetero ring, $L_2$, $L_3$, $L_4$ and $L_5$ each represents a methine group, $p_1$ represents 0 or 1, $n_1$ represents an integer of from 0 to 3, $M_1$ represents a counter ion for attaining the charge balance, and $m_2$ represents the number of counter ions for neutralizing charges on the molecule and ranges from 0 to 10.

Examples of a 5- or 6-membered nitrogen-containing hetero ring completed by $Z_4$ include thiazolidine, thiazole, benzothiazole, oxazoline, oxazole, benzoxazole, selenazoline, selenazole, benzoselenazole, 3,3-dialkylindolenine (such as 3,3-dimethylindolenine), imidazoline, imidazole, benzimidazole, 2-pyridine, 4-pyridine, 2-quinoline, 4-quinoline, 1-isoquinoline, 3-isoquinoline, imidazo[4,5-b]quinoxaline, oxadiazole, thiadiazole, tetrazole and pyrimidine nuclei.

The 5- or 6-membered nitrogen-containing hetero ring completed by $Z_4$ may have the substituent Y as recited hereinbefore.

$L_2$, $L_3$, $L_4$ and $L_5$ in the foregoing formula are independent methine groups. The methine group represented by $L_2$, $L_3$, $L_4$ and $L_5$ each may have a substituent. Examples of such a substituent include substituted or unsubstituted alkyl groups containing 1 to 15 carbon atoms (such as methyl, ethyl and 2-carbooxyethyl), substituted or unsubstituted aryl groups containing 6 to 20 carbon atoms (such as phenyl and o-carboxyphenyl), substituted or unsubstituted heterocyclic group containing 3 to 20 carbon atoms (such as N,N-diethylbarbituric acid group), halogen atoms (such as chlorine, bromine, fluorine and iodine), alkoxy groups containing 1 to 15 carbon atoms (such as methoxy and ethoxy), alkylthio groups containing 1 to 15 carbon atoms (such as methylthio and ethylthio), arylthio groups containing 6 to 20 carbon atoms (such as phenylthio) and amino groups containing 0 to 15 carbon atoms (such as N,N-diphenylamino, N-methyl-N-phenylamino and N-methylpiperazine).

Each of the methine groups may combine with another methine group to form a ring. In addition, it is equally possible that each methine group combines with some other moiety to form a ring.

$M_1$ is incorporated in formula (X-7) to indicate the presence of cation(s) or anion(s) required for neutralizing ionic charge on the light absorbing group. Examples of typical cation include hydrogen ion ($H^+$), inorganic cations such as alkali metal ions (e.g., sodium, potassium and lithium ions), and organic cations such as ammonium ions (e.g., ammonium, tetraalkylammonium, pyridinium and ethylpyridinium ions). The anions also may be inorganic or organic ones, with examples including halogen anions (such as fluorine, chlorine and iodine ions), substituted arylsulfonic acid ions (such as p-toluenesulfonic acid ion and p-chlorobenzenesulfonic acid ion) aryldisulfonic acid ions (such as 1,3-benzenedisulfonic acid ion, 1,5-naphthalenedisulfonic acid ion and 2,6-naphthalenedisulfonic acid ion), alkylsulfate ions (such as methylsulfate ion), sulfuric acid ion, thiocyanic acid ion, perchloric acid ion, tetrafluoroboric acid ion, picric acid ion, acetic acid ion, and trifluoromethanesulfonic acid ion. Further, ionic polymers or other light absorbing groups bearing the opposite charge may be used as $M_1$.

Herein, the sulfo group and the carboxyl group are shown, e.g., by $SO_3^-$ and $CO_2^-$, respectively. When the counter ion is hydrogen ion, however, these groups are represented by $SO_3H$ and $CO_2H$ respectively.

$m_2$ is the number required for attaining the charge balance, and it is 0 when the inner salt is formed.

Of the light-absorbing groups represented by formula (X-7), the following are desirable.

In the above formula, it is desirable that $Z_4$ be a benzoxazole, benzothiazole, benzimidazole or quinoline nucleus, $L_2$, $L_3$, $L_4$ and $L_5$ be each an unsubstituted methine group, $P_1$ is 0 and $n_1$ is 1 or 2.

Therein, it is more desirable that $Z_4$ be a benzoxazole or benzothiazole nucleus and $n_1$ is 1. In particular, the benzothiazole nucleus is preferred as $Z_4$.

1 in formula (I) is preferably 0 or 1, more preferably 1.

Examples of the group X used in the invention are illustrated below, but these examples should not be construed as limiting the scope of the invention in any way.

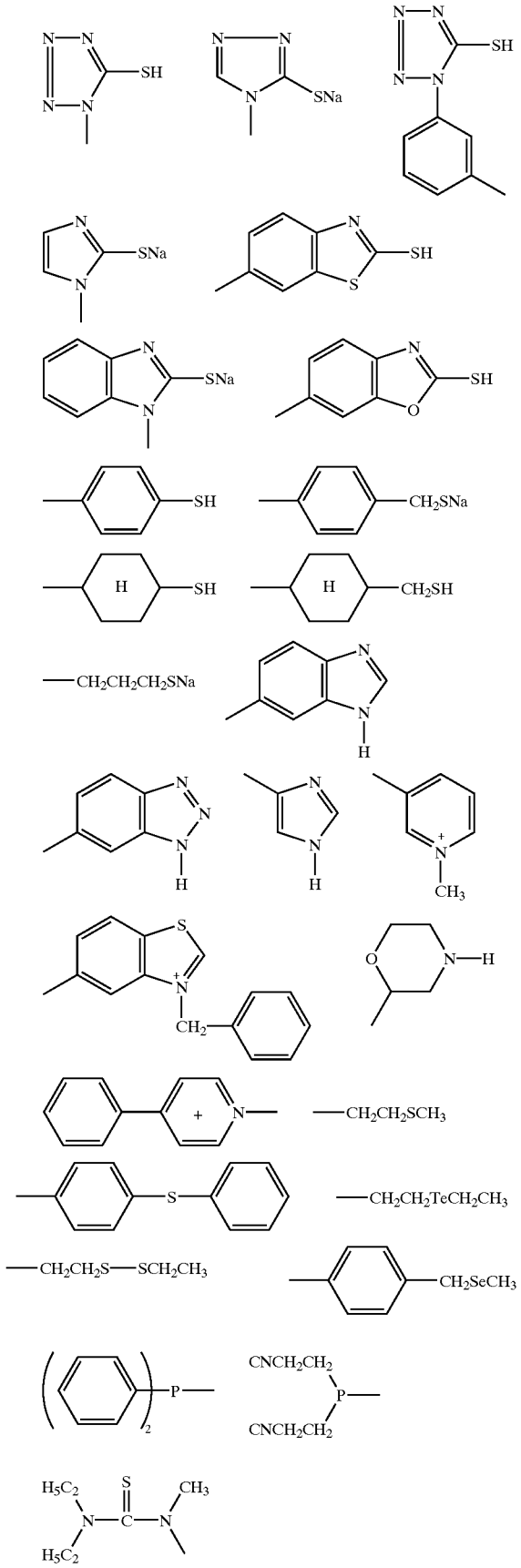

-continued

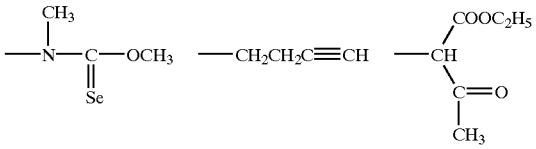

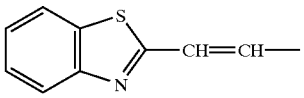

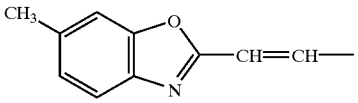

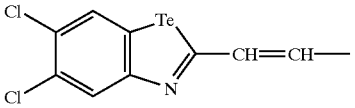

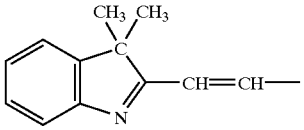

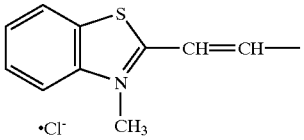

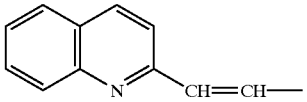

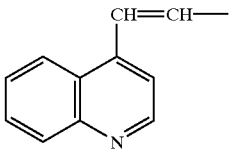

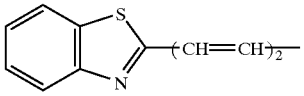

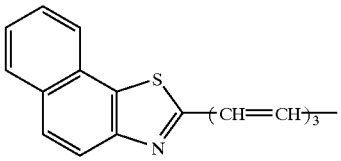

The linkage group represented by L in formula (I) is illustrated below.

Examples of such a linkage group include substituted or unsubstituted, straight-chain or branched alkylene groups containing 1 to 20 carbon atoms (such as methylene, ethylene, trimethylene, isopropylene, tetramethylene, hexamethylene, 3-oxapentylene and 2-hydroxytrimethylene), substituted or unsubstituted cycloalkylene groups containing 3 to 18 carbon atoms (such as cyclopropylene, cyclopentylene and cyclohexylene), substituted or unsubstituted alkenylene groups containing 2 to 20 carbon atoms (such as ethenylene and 2-butenylene), alkynylene groups containing 2 to 10 carbon atoms (such as ethynylene), substituted or unsubstituted arylene groups containing 6 to 20 carbon atoms (such as unsubstituted p-phenylene and unsubstituted 2,5-naphthylene), heterocyclic linkage groups (such as 2,6-pyridylene), a carbonyl group (—CO—), a thiocarbonyl group (—CS—), an imido group (—NH—), a sulfonyl group (—$SO_2$—), a sulfonate linkage (—$SO_2$—O—), an ester linkage (—COO—), a thoester linkage (—CSO—), an amido linkage (—CONH—), an ether linkage (—O—), a thoether linkage (—S—), an ureide linkage (—NHCONH—), a thioureide linkage (—NHCSNH—) and a thiosulfonyl group (—$SO_2$—S—). Two or more of these linkage groups may combine with each other to form a new linkage group.

L may further have the substituent Y as recited above.

It is desirable that the linkage group L be an unsubstituted alkylene group containing 1 to 10 carbon atoms or a group formed by linking —NH—, —CONH—, —S—, —NHCONH— or —$SO_2$— with an alkylene group containing 1 to 10 carbon atoms, preferably an unsubstituted alkylene group containing 1 to 6 carbon atoms or a group formed by linking —NH—, —NHCO— or —S— with an alkylene group containing 1 to 6 carbon atoms.

m in formula (I) is preferably 0 or 1, more preferably 1.

Then, the electron-donating group A is illustrated below.

The sensitivity increase can be attained with a reaction mechanism that the A—B moiety is oxidized and fragmentized to release an electron and produce radical B. and further the radical B. undergoes oxidation to produce an electron. This reaction mechanism is shown below:

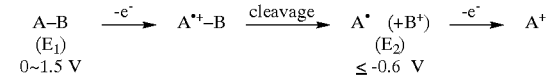

As A is an electron-donating group, it is desirable that the substituent(s) on an aromatic nucleus be selected so as to bring about an excessive state of electron in the group no matter what structure the nucleus has. More specifically, it is desirable that the oxidation potential be adjusted to the appropriate range by introducing into an aromatic nucleus, for example, electron-donating substituent(s) in a case where the nucleus is not in an excessive state of electron, or electron-attracting substituent(s) in a case where the nucleus is in a state of large excess electron, such as in a case of anthracene.

The groups suitable for the group A are those having the following formulae (A-1), (A-2) and (A-3) respectively:

(A-1)

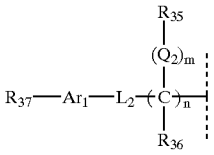

(A-2)

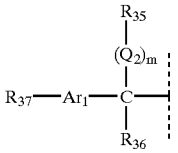

-continued (A-3)

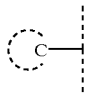

In formulae (A-1) and (A-2), $R_{35}$ and $R_{36}$ each represents a hydrogen atom, or a substituted or unsubstitued alkyl, aryl, alkylene or arylene group; $R_{37}$ represents an alkyl group, COOH, halogen, $N(R_{38})_2$, $(OH)_n$, $(OR_{38})_n$, $(SR_{38})_n$, $OR_{36}$, $SR_{38}$, CHO, $COR_{38}$, $COOR_{38}$, $CONHR_{38}$, $CON(R_{38})_2$, $SO_3R_{38}$, $SO_2NHR_{38}$, $SO_2NR_{38}$, $SO_2R_{38}$, $SOR_{38}$ or $CSR_{38}$; and $Ar_1$ represents an arylene group or a heterocyclic group. Herein, $R_{35}$ and $R_{36}$, or $R_{35}$ and $Ar_1$ may combine with each other to form a ring. $Q_2$ represents O, S, Se or Te, m is 0 or 1, and n is 1 to 3. $L_2$ represents N—R, N—Ar, O, S or Se. The form of the foregoing ring is a 5- to 7-membered heterocyclic ring or unsaturated hydrocarbon ring. $R_{38}$ represents a hydrogen atom, an alkyl group or an aryl group.

The ring form of formula (A-3) is a substituted or unsubstitutted 5- to 7-membered unsaturated ring or heterocyclic ring.

Further, the formulae (A-1), (A-2) and (A-3) are illustrated in detail.

The alkyl group represented by $R_{35}$ and $R_{36}$ each in formulae (A-1) and (A-2) includes substituted or unsubstituted, straight-chain or branched alkyl groupd containing 1 to 10 carbon atoms (e.g., methyl, ethyl, isopropyl, n-propyl, n-butyl, t-butyl, 2-pentyl, n-hexyl, n-octyl, t-octyl, 2-ethylhexyl, 2-hydroxyethyl, 1-hydroxyethyl, diethylaminoethyl, dibutyl-aminoethyl, n-butoxymethyl, methoxymethyl) and substituted or unsubstituted cycloalkyl group containing 3 to 6 carbon atoms (e.g., cyclopropyl, cyclopentyl, cyclohexyl), and the aryl group represented thereby includes substituted or unsubstituted aryl groups containing 6 to 12 carbon atoms (e.g., unsubstituted phenyl, 2-methylphenyl).

The alkylene group represented by $R_{35}$ and $R_{36}$ each in those formulae includes substituted or unsubstituted, straight-chain or branched alkylene groups containing 1 to 10 carbon atoms (e.g., methylene, ethylene, trimethylene, tetramethylene, methoxyethylene), and the arylene group represented thereby includes substituted or unsubstituted arylene groups containing 6 to 12 carbon atoms (e.g., unsubstituted phenylene, 2-methylphenylene, naphthylene).

The group represented by $R_{37}$ in formulae (A-1) and (A-2) includes alkyl groups (e.g., methyl, ethyl, isopropyl, n-propyl, n-butyl, 2-pentyl, n-hexyl, n-octyl, 2-ethylhexyl, 2-hydroxyethyl, n-butoxymethyl), a carboxyl group, halogen atoms (e.g., fluorine, chlorine, bromine), OH, $N(CH_3)_2$, $NPh_2$, $OCH_3$, OPh, $SCH_3$, SPh, CHO, $COCH_3$, COPh, $COOC_4H_5$, $COOCH_3$, $CONHC_2H_5$, $CON(CH_3)_2$, $SO_3CH_3$, $SO_3C_3H_7$, $SO_2NHCH_3$, $SO_2N(CH_3)_2$, $SOCH_3$, CSPh and $CSCH_3$.

$Ar_1$ in formulae (A-1) and (A-2) includes substituted or unsubstituted arylene groups containing 6 to 12 carbon atoms (e.g., phenylene, 2-methylphenylene, naphthylene) and substituted or unsubstituted heterocyclic groups (e.g., groups derived from pyrydine, 3-phenylpyridine and morpholine).

$L_2$ in formula (A-1) includes NH, $NCH_3$, $NC_4H_9$, $NC_3H_7$ (i), NPh, N(Ph—$CH_3$), O, S, Se and Te.

The ring formed in formula (A-3) includes unsaturated 5 to 7-membered rings and heterocyclic rings (e.g., furan, piperidine, morpholine).

$R_{35}$, $R_{36}$, $R_{37}$, $Ar_1$ and $L_2$ in formulae (A-1) and (A-2), and the ring in formula (A-3) each may further have the substituent Y as recited hereinbefore.

Suitable examples of groups represented by formulae (A-1), (A-2) and (A-3) respectively are described below.

In formulae (A-1) and (A-2), it is desirable that $R_{35}$ and $R_{36}$ each be a substituted or unsubstituted alkyl group containing 1 to 6 carbon atoms, an alkylene group or a substituted or unsubstituted aryl group containing 6 to 10 carbon atoms, $R_{37}$ be a substituted or unsubstituted alkyl group containing 1 to 6 carbon atoms, an amino group substituted by one or two of alkyl groups containing 1 to 4 carbon atoms, a carboxyl group, a halogen atom or an esterified carboxylic acid residue containing 2 to 4 carbon atoms, $Ar_1$ be a substituted or unsubstituted arylene group containing 6 to 10 carbon atoms, $Q_2$ be O, S or Se, m be 0 or 1, n be 1 to 3, and $L_2$ be an unsubstituted imino group or 1–3C alkyl-substituted imino group.

In formula (A-3), it is desirable that the ring formed be a 5- to 7-membered hetero ring.

Moreover, it is preferable in formulae (A-1) and (A-2) that $R_{35}$ and $R_{36}$ each be a substituted or unsubstituted alkyl group containing 1 to 4 carbon atoms or an alkylene group, $R_{37}$ be an unsubstituted alkyl group containing 1 to 4 carbon atoms or an amino group substituted by one or two of alkyl groups containing 1 to 4 carbon atoms, $Ar_1$ be a substituted or unsubstituted arylene group containing 6 to 10 carbon atoms, $Q_2$ be O or S, m is 0, n be 1, and $L_2$ be an unsubstituted or 1–3C alkyl-substituted imino group.

In formula (A-3), the ring formed is preferably a 5- or 6-membered hetero ring.

The group X is bonded to the $Ar_1$, $R_{35}$ or $R_{36}$ moiety of the group A.

Examples of the group A usable in the invention are illustrated below, but these examples should not be construed as limiting the scope of. the invention in any way.

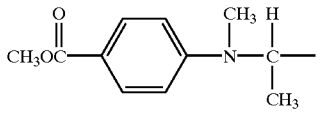

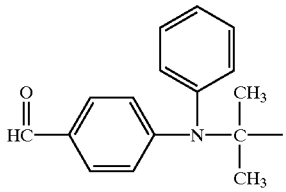

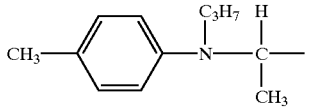

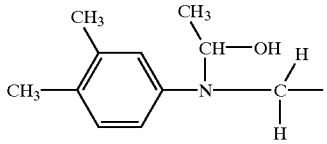

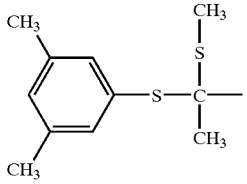

-continued
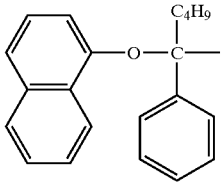
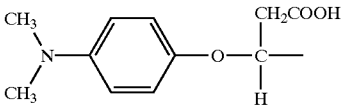
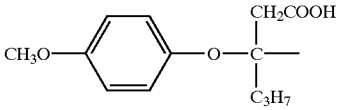
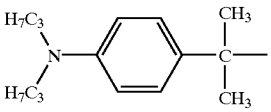
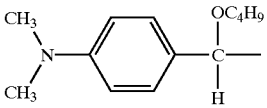
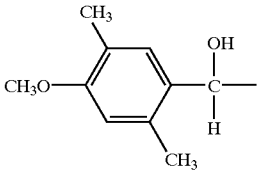
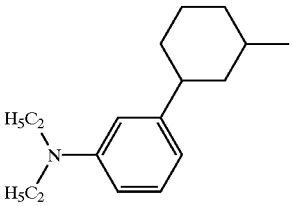
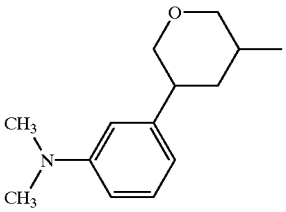
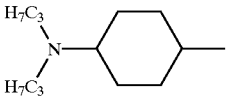
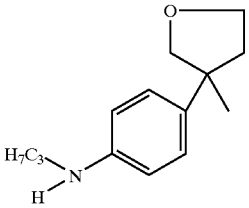
-continued
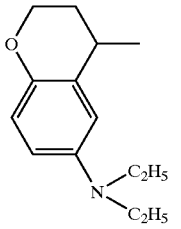
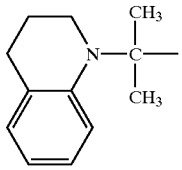
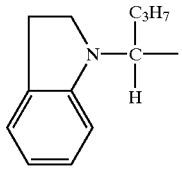
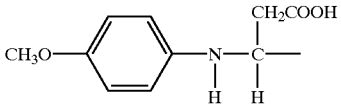
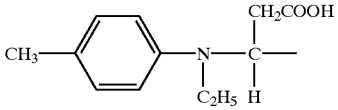
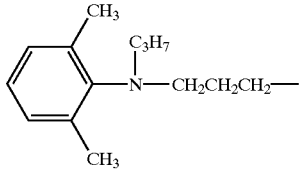
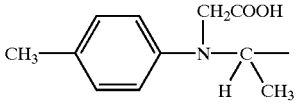
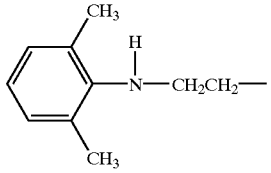
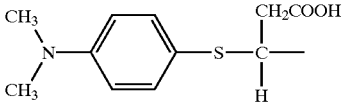
Then, the releasing group B is illustrated in detail.
The groups suitable for B are represented by the following formulae (B-1), (B-2) and (B-3) respectively.
(B-1)
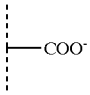
(B-2)
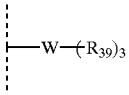

-continued (B-3)

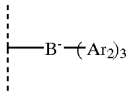

In formulae (B-2) and (B-3), W represents Si, Sn or Ge, $R_{39}$ groups each represent an alkyl group, and $Ar_2$ groups each represent an aryl group.

The group represented by formulae (B-2) and (B-3) each can be bonded to the adsorbing group X.

Then, formulae (B-2) and (B-3) are illustrated in detail.

The alkyl group represented by $R_{39}$ includes substituted or unsubstituted, straight-chain or branched alkyl groups containing 1 to 6 carbon atoms (e.g., methyl, ethyl, isopropyl, n-propyl, n-butyl, t-butyl, 2-pentyl, n-hexyl, n-octyl, t-octyl, 2-ethylhexyl, 2-hydroxyethyl, 1-hydroxyethyl, n-butoxyethyl, methoxymethyl), and the aryl group represented by $Ar_2$ includes substituted or unsubstituted aryl groups containing 6 to 12 carbon atoms (e.g., phenyl, 2-methylphenyl).

$R_{39}$ and $Ar_2$ in formulae (B-2) and (B-3) respectively may further have the substituent Y as recited hereinbefore.

In formulae (B-2) and (B-3), it is desirable that $R_{39}$ be a substituted or unsubstituted alkyl group containing 1 to 4 carbon atoms, $Ar_2$ be a substituted or unsubstituted aryl group containing 1 to 10 carbon atoms and W be Si or Sn.

Therein, it is more desirable that $R_{39}$ be a substituted or unsubstituted alkyl group containing 1 to 3 carbon atoms, $Ar_2$ be a substituted or unsubstituted aryl group containing 6 to 8 carbon atoms and W be Si.

Of the groups represented by formulae (B-1), (B-2) and (B-3), the most desirable ones are $COO^-$ represented by formula (B-1) and $Si(R_{39})_3$ in formula (B-2)

In formula (I), it is desirable for "n" to be 1.

Examples of a compound represented by A—B which can be used in the invention are illustrated below, but these examples should not be construed as limiting the scope of the invention in any way.

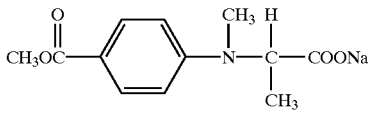

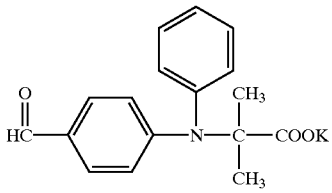

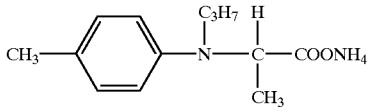

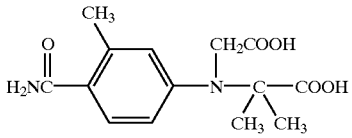

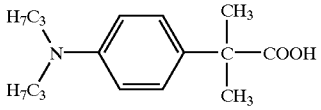

-continued

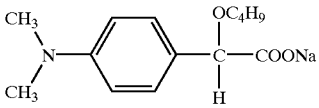

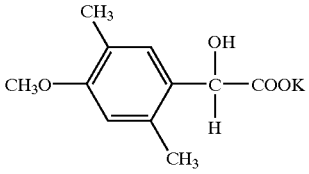

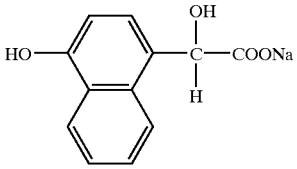

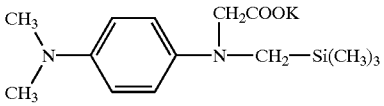

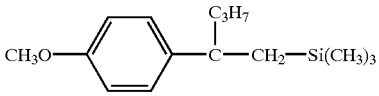

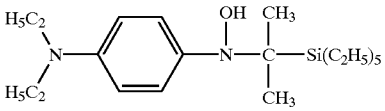

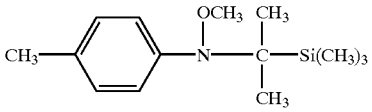

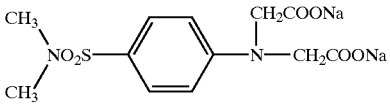

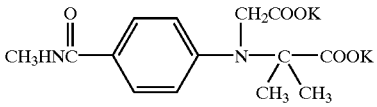

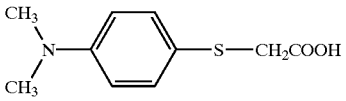

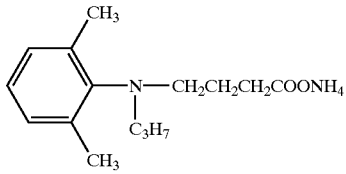

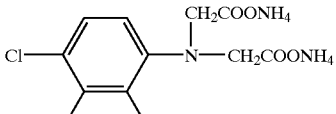

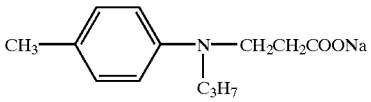

-continued

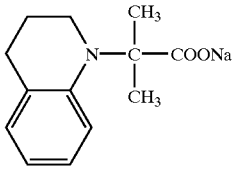

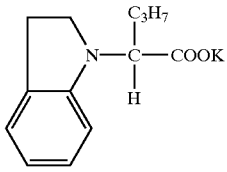

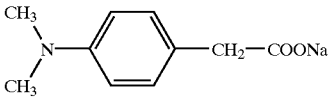

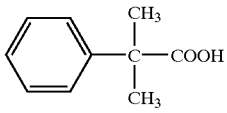

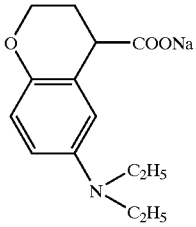

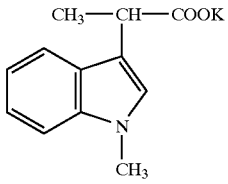

Examples of counter ions required for attaining charge balance in the compounds as illustrated above include sodium ion, potassium ion, triethylammonium ion, diisopropylammonium ion, tetrabutylammonium ion and tetramethylguanidinium ion.

The oxidation potential of A—B ($E_1$) is desirably from 0 to 1.5 V, preferably from 0 to 1.0 V, particularly preferably from 0.3 to 1.0 V.

The oxidation potential of the radical A. generated from the bond cleavage reaction ($E_2$) is desirably from −0.6 to −2.5 V, preferably from −0.9 to −2.0 V, particularly preferably from −0.9 to −1.6 V.

The methods for measuring the foregoing oxidation potentials are described below.

$E_1$ can be determined using cyclic voltammetry. More specifically, the electron doner A is dissolved in a solution containing acetonitrile and 0.1M water solution of lithium perchlorate in a ratio of 80/20 by volume %. A vitrified carbon disk is used as an operating electrode, a platinum wire is used as a counter electrode, and the saturated calomel electrode (SCE) is used as a reference electrode. The measurement is made at 25° C. with a potential scanning speed of 0. 1 V/sec. And the oxidation potential vs. SCE at the peak potential of cyclic voltammetry wave is taken as $E_1$. The $E_1$ values of compounds represented by A—B are disclosed in EP-A-93731.

The oxidation potential measurements of radicals can be made using transient electrochemistry and pulse radiolysis. These are reported in J. Am. chem. Soc. , 110, 132 (1988), ibid., 96, 1287 (1974), and ibid., 96, 1295 (1974).

Examples of compounds represented by formula (I) are illustrated below. However, the compounds usable in the invention should not be construed as being limited to these examples.

(I-1)

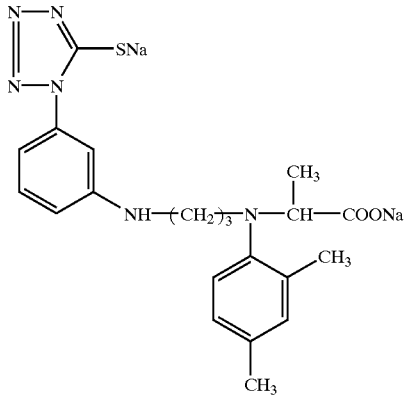

(I-2)

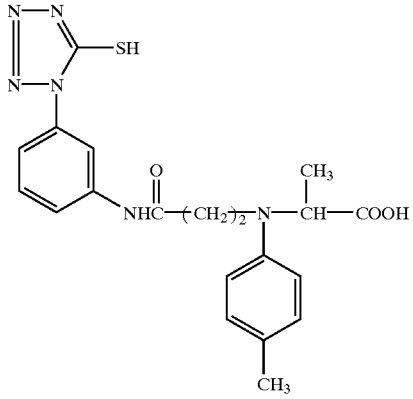

(I-3)

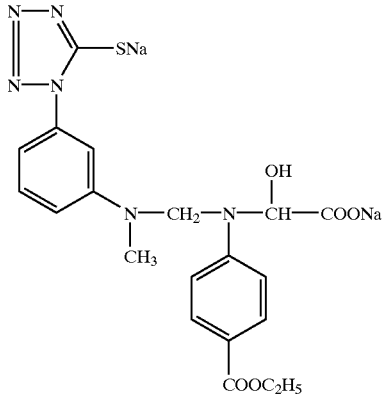

(I-4)

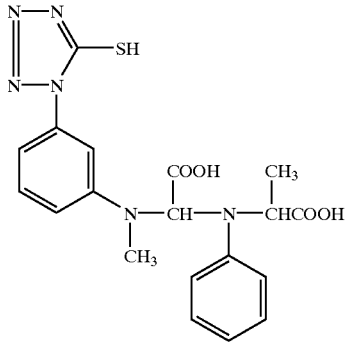

-continued
(I-5)
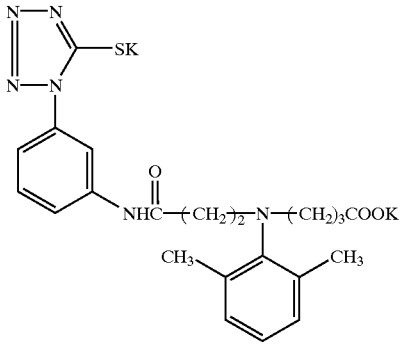
(I-6)
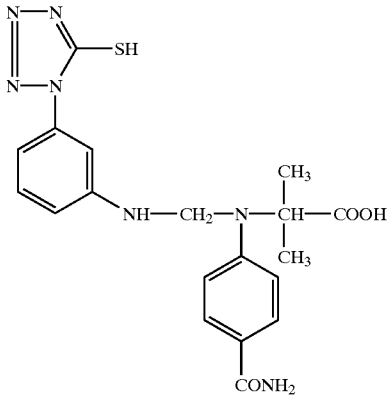
(I-7)
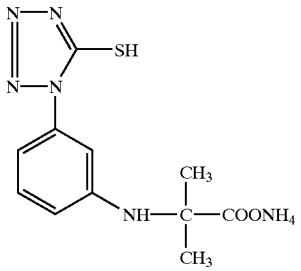
(I-8)
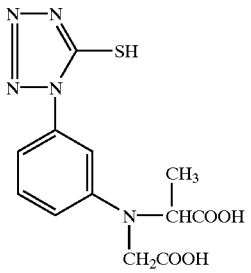
(I-9)
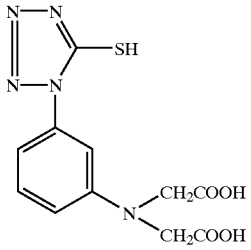
-continued
(I-10)
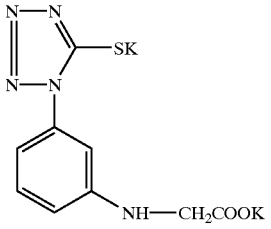
(I-11)
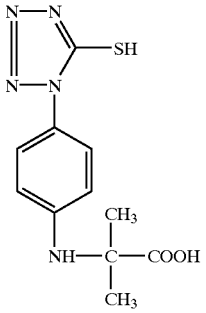
(I-12)
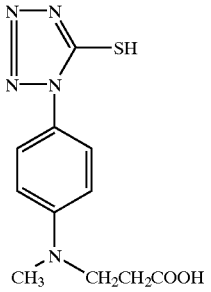
(I-13)
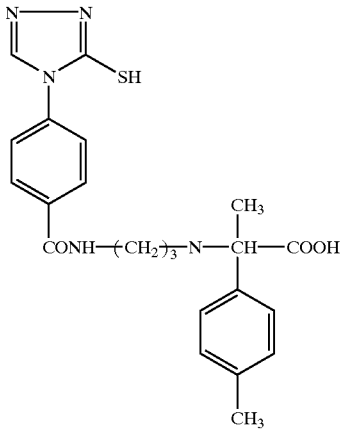
(I-14)
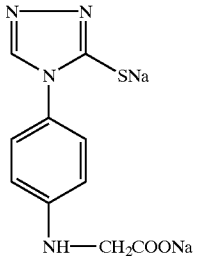

-continued
(I-15)
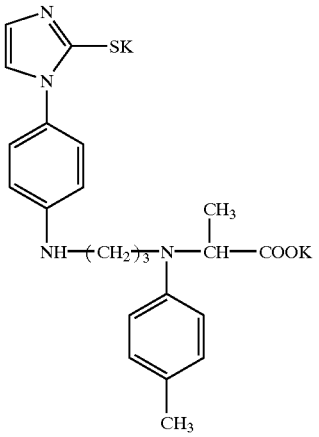
(I-16)
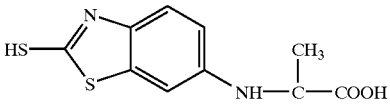
(I-17)
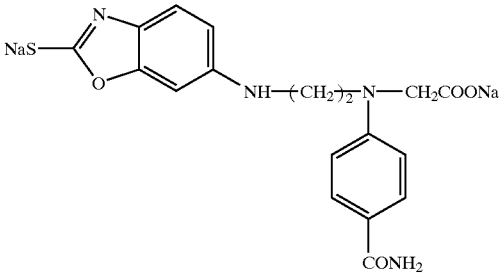
(I-18)
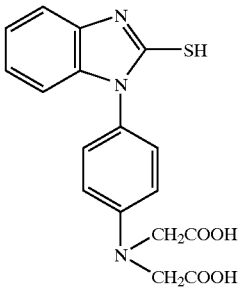
(I-19)
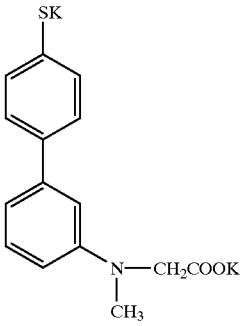
-continued
(I-20)
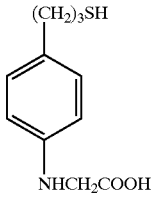
(I-21)
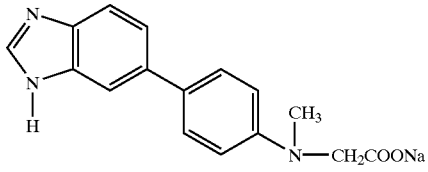
(I-22)
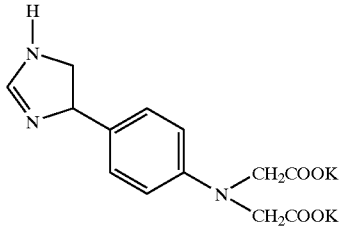
(I-23)
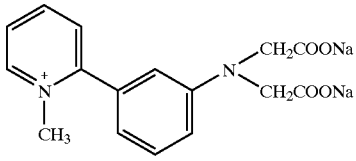
(I-24)
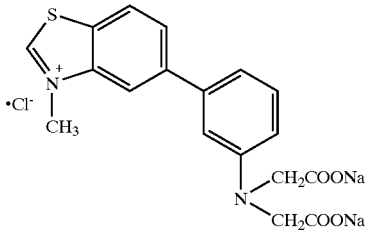
(I-25)
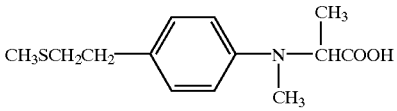
(I-26)
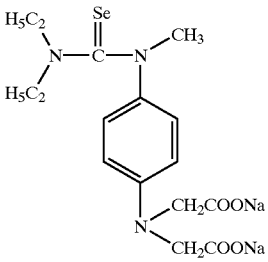
(I-27)
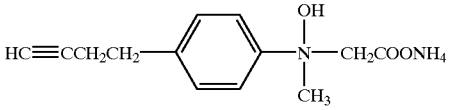

-continued (I-28)

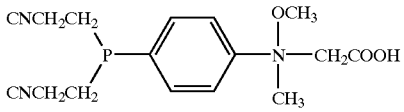

(I-29)

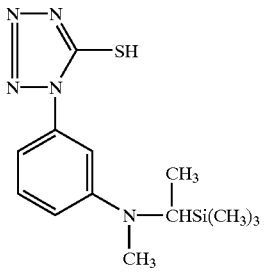

(I-30)

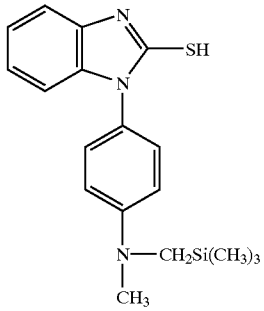

(I-31)

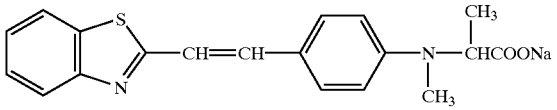

(I-32)

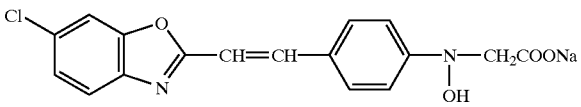

(I-33)

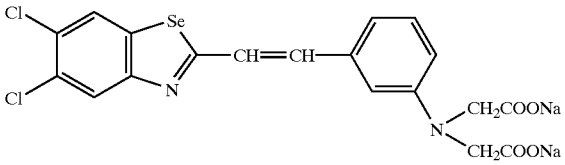

(I-34)

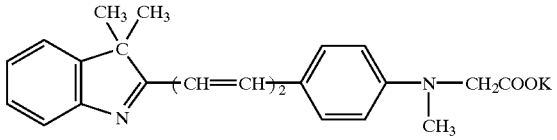

(I-35)

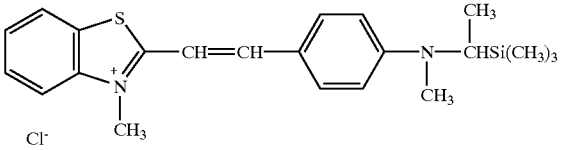

The compounds represented by formula (I) can be synthesized with ease by the use of the methods disclosed in U.S. Pat. Nos. 5,747,235 and 5,747,236, EP-A-786692, EP-A-893731, EP-A-893732 and WO99/05570, and those following these methods.

The suitable amount of a compound represented by formula (I) incorporated in an emulsion layer is from $1\times10^{-9}$ to $2\times10^{-2}$ mole/mole of silver, preferably from $1\times10^{-7}$ to $2\times10^{-3}$ mole/mole silver.

In the next place, compounds represented by formulae (II) to (VI) respectively are illustrated below.

Examples of alkyl, alkenyl and alkynyl groups represented by $R_1$ and $R_2$ each in formula (II) include substituted or unsubstituted straight-chain or branched alkyl groups containing 1 to 10 carbon atoms (such as methyl, ethyl, isopropyl, n-propyl, n-butyl, t-butyl, 2-pentyl, n-hexyl, n-octyl, t-octyl, 2-ethylhexyl, hydroxymethyl, 2-hydroxyethyl, 1-hydroxyethyl, diethylaminoethyl, dibutylaminoethyl, n-butoxypropyl and methoxymethyl), substituted or unsubstituted cycloalkyl groups containing 3 to 6 carbon atoms (such as cyclopropyl, cyclopentyl and cyclohexyl), alkenyl groups containing 2 to 10 carbon atoms (such as allyl, 2-butenyl and 3-pentenyl), alkynyl groups containing 2 to 10 carbon atoms (such as propargyl and 3-pentynyl), and aralkyl groups containing 7 to 12 carbon atoms (such as benzyl); and examples of an aryl group represented by $R_1$ and $R_2$ each include substituted or unsubstituted phenyl groups containing 6 to 12 carbon atoms (such as unsubstituted phenyl and 4-methylphenyl).

Examples of alkyl, alkenyl and alkynyl groups represented by $R_3$ and $R_4$ each in formula (II) include substituted or unsubstituted straight-chain or branched alkyl groups containing 1 to 10 carbon atoms (such as methyl, ethyl, isopropyl, n-propyl, n-butyl, t-butyl, 2-pentyl, n-hexyl, n-octyl, t-octyl, 2-ethylhexyl, 2-hydroxyethyl, diethylaminoethyl, dibutylaminoethyl, methoxyethyl and ethoxyethoxyethyl), substituted or unsubstituted cycloalkyl groups containing 3 to 6 carbon atoms (such as cyclopropyl, cyclopentyl and cyclohexyl), alkenyl groups containing 2 to 10 carbon atoms (such as allyl, 2-butenyl and 3-pentenyl), alkynyl groups containing 2 to 10 carbon atoms (such as propargyl and 3-pentynyl), and aralkyl groups containing 7 to 12 carbon atoms (such as benzyl); and examples of an aryl group represented by $R_3$ and $R_4$ each include substituted or unsubstituted phenyl groups containing 6 to 12 carbon atoms (such as unsubstituted phenyl and 4-methylphenyl), and substituted or unsubstituted naphthyl groups containing 10 to 16 carbon atoms (such as unsubstituted naphthyl).

Further, $R_1$ or $R_2$ may combine with $R_3$ or $R_4$ to complete a ring.

Examples of alkyl, alkenyl and alkynyl groups represented by $R_5$ in formula (II) include substituted or unsubstituted straight-chain or branched alkyl groups containing 1 to 8 carbon atoms (such as methyl, ethyl, isopropyl, n-propyl, n-butyl, t-butyl, 2-pentyl, n-hexyl, n-octyl, t-octyl, 2-ethylhexyl, 2-hydroxyethyl and diethylaminoethyl), substituted or unsubstituted cycloalkyl groups containing 3 to 6 carbon atoms (such as cyclopropyl, cyclopentyl and cyclohexyl), alkenyl groups containing 2 to 10 carbon atoms (such as allyl, 2-butenyl and 3-pentenyl), alkynyl groups containing 2 to 10 carbon atoms (such as propargyl and 3-pentynyl), and aralkyl groups containing 7 to 12 carbon atoms (such as benzyl); examples of an aryl group represented by —$R_5$ include substituted or unsubstituted phenyl groups containing 6 to 16 carbon atoms (such as unsubstituted phenyl, 4-methylphenyl, 4-(2-hydroxyethyl)phenyl, 4-sulfophenyl, 4-chlorophenyl, 4-trifluoromethylphenyl, 3-trifluoromethylphenyl, 4-carboxy-phenyl, 2,5-dimethylphenyl, 4-dimethylaminophenyl, 4-(3-carboxypropionylamino)phenyl, 4-methoxyphenyl, 2-methoxy-phenyl, 2,5-dimethoxyphenyl and 2,4,6-trimethylphenyl), and substituted or unsubstituted naphthyl groups containing 10 to 16 carbon atoms (such as unsubstituted naphthyl and 4-methylnaphthyl); and examples of a heterocyclic group represented by $R_5$ include pyridyl, furyl, imidazolyl, piperidyl and morpholinyl groups.

Each of $R_1$, $R_2$, $R_3$, $R_4$ and $R_5$ in formula (II) may further have the substituent Y as recited hereinbefore.

Of the compounds represented by formula (II), desirable ones are as follows: In formula (II), $R_1$ and $R_2$ are each a substituted or unsubstituted straight-chain or branched alkyl group containing 1 to 4 carbon atoms or a substituted or unsubstituted phenyl group containing 6 to 10 carbon atoms, $R_3$ and $R_4$ are each a hydrogen atom, a substituted or unsubstituted straight-chain or branched alkyl group containing 1 to 4 carbon atoms or a substituted or unsubstituted phenyl group containing 6 to 10 carbon atoms, $R_5$ is a substituted or unsubstituted phenyl group containing 6 to 12 carbon atoms, and besides, the compounds fitting to the foregoing conditions have molecular weight of at most 350.

It is more desirable in formula (II) that $R_1$ and $R_2$ each be a substituted or unsubstituted straight-chain alkyl group containing 1 to 3 carbon atoms, $R_3$ and $R_4$ each be a hydrogen atom, $R_5$ be a substituted or unsubstituted phenyl group containing 6 to 10 carbon atoms, and besides, the compounds fitting to these conditions have molecular weight of at most 300. Particularly, it is advantageous that the total number of carbon atoms contained in $R_1$ to $R_5$ be at most 11.

Examples of a compound represented by formula (II) are illustrated below, but the invention should not be construed as being limited by these examples.

(II-1)

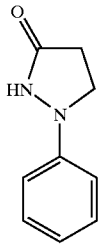

(II-2)

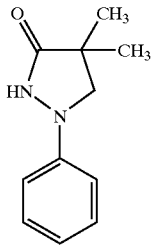

(II-3)

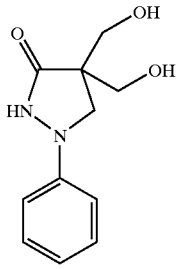

-continued (II-4)

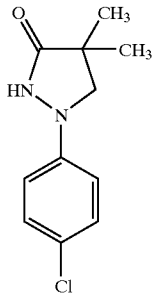

(II-5)

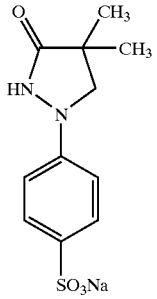

(II-6)

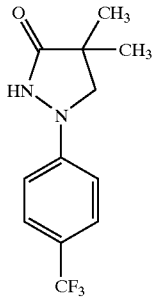

(II-7)

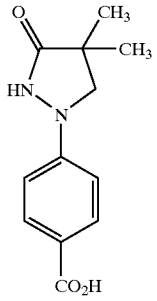

(II-8)

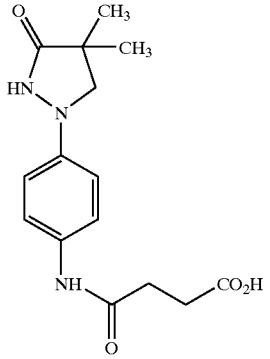

-continued
(II-9)
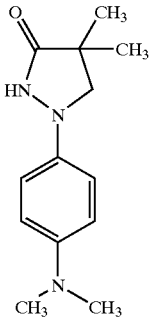
(II-10)
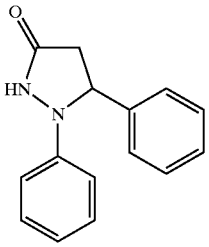
(II-11)
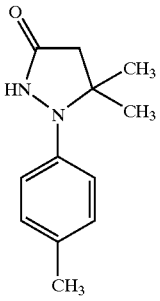
(II-12)
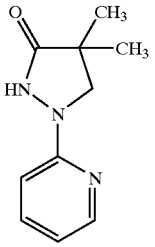
(II-13)
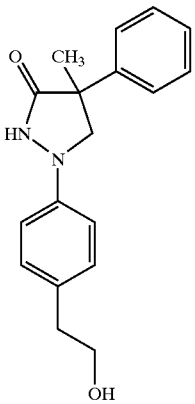
-continued
(II-14)
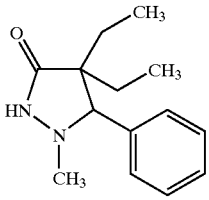
(II-15)
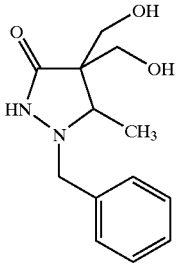
(II-16)
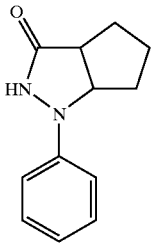
(II-17)
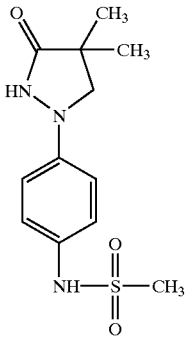
(II-18)
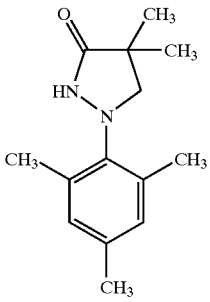

-continued (II-19)

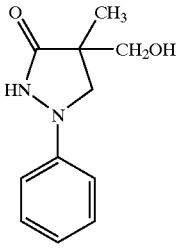

The compounds represented by formula (II) can be obtained with ease as commercially produced chemicals or compounds synthesized therefrom by the use of known methods. Also, the compounds represented by formula (II) can be easily synthesized using the methods as described in *J. Chem. Soc.,* 408 (1954), U.S. Pat. No. 2,743,279 (1953) and U.S. Pat. No. 2,772,282 (1953), or the methods based thereon.

It is desirable that the compounds represented by formula (II) be added to a layer adjacent to or other than an emulsion layer by incorporating them in a coating composition for forming such a layer before or at the time when the coating composition is coated, and then allowed to be dispersed into the emulsion layer. However, they may be added to an emulsion during the emulsion-making, specifically before, during or after chemical sensitization. In other words, the compounds represented by formula (II) can be added to a light-sensitive layer as well as a light-insensitive layer.

The appropriate addition amount of those compounds, though it depends largely on the addition method adopted and the species of the compound(s) added, is generally from $5\times10^{-6}$ to 0.05 mole, preferably from $1\times10^{-5}$ to 0.005 mole, per mole of light-sensitive silver halide. When the amount added is greater than the foregoing upper limit, undesirable results, including an increase in fog, are produced.

In adding the compounds represented by formula (II), it is desirable that they be dissolved in a solvent soluble in water. The pH of their solutions may be lowered or heightened by adding thereto an acid or a base. On the other hand, the surfactants may be present therein. Those compounds may be dissolved in high boiling organic solvents and added as emulsified dispersions, or they may be made into microcrystalline dispersions according to known methods and then added.

The compounds represented by formula (III) are illustrated below in detail.

First the hydrazine structure represented by $R_6R_7N$—$NR_8R_9$ suitable for Hy is described in detail.

$R_6$, $R_7$, $R_8$ and $R_9$ each represents an alkyl group, an alkenyl group, an alkynyl group, an aryl group or a heterocyclic group. Further, $R_6$ and $R_7$, $R_8$ and $R_9$, $R_6$ and $R_8$, or $R_7$ and $R_9$ may combine with each other to form a ring so far as the ring is not an aromatic hetero ring.

However, at least one among $R_6$, $R_7$, $R_8$ and $R_9$ is required to be an alkylene group, an alkenylene group, an alkynylene group, arylene group or a divalent heterocyclic reside for enabling Hy to link with the —$(Q_1)_{k2}$—$(Het)_{k1}$ moiety in formula (III).

Examples of $R_6$, $R_7$, $R_8$ and $R_9$ each includes unsubstituted alkyl, alkenyl and alkynyl groups containing 1 to 18, preferably 1 to 8, carbon atoms (such as methyl, ethyl, propyl, isopropyl, butyl, isobutyl, hexyl, octyl, dodecyl, octadecyl, cyclopentyl, cyclopropyl and cyclohexyl), and substituted alkyl, alkenyl and alkynyl groups containing 1 to 18 carbon atoms, preferably 1 to 8 carbon atoms.

The ring formed by combining $R_6$ with $R_7$, $R_8$ with $R_9$, $R_6$ with $R_8$, or $R_7$ with $R_9$ may have the substituent Y as recited hereinbefore.

Suitable examples for $R_6$, $R_7$, $R_8$ and $R_9$ each includes unsubstituted alkyl, alkenyl and alkynyl groups, substituted alkyl, alkenyl and alkynyl groups, and an alkylene group, which may have a substituent (for example, the substituent Y as recited hereinbefore), in the case of forming a ring by $R_6$ and $R_7$, $R_8$ and $R_9$, $R_6$ and $R_8$, or $R_7$ and $R_9$ being combined with each other.

More suitable examples of a more desirable group for $R_6$, $R_7$, $R_8$ and $R_9$ each includes groups wherein the carbon atom attached to the nitrogen atom of hydrazine has the form of unsubstituted methylene. As particularly suitable examples for $R_6$, $R_7$, $R_8$ and $R_9$ each, mention may be made of unsubstituted alkyl groups containing 1 to 6 carbon atoms (such as methyl, ethyl, propyl and butyl), substituted alkyl groups containing 1 to 8 carbon atoms (e.g. , sulfoalkyl groups, such as 2-sulfoethyl, 3-sulfopropyl, 4-sulfobutyl and 3-sulfobutyl; carboxyalkyl groups, such as carboxymethyl and 2-carboxyethyl; hydroxyalkyl groups, such as 2-hydroxyethyl), and alkylene groups for forming 5- to 7-menbered rings in the case where $R_6$ and $R_7$, $R_8$ and $R_9$, $R_6$ and $R_8$, or $R_7$ and $R_9$ are combined with each other to complete those rings.

The hydrazine represented by $R_6R_7N$—$NR_8R_9$ has at least one substituent represented by —$(Q_1)_{k2}$—$(Het)_{k1}$. Such a substituent may be located in any of $R_6$, $R_7$, $R_8$ and $R_9$.

Further, the compounds represented by the following formulae (Hy-1), (Hy-2) and (Hy-3) respectively are desirable in particular for the compounds represented by $R_6R_7N$—$NR_8R_9$ in the invention:

(Hy-1)

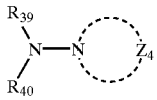

(Hy-2)

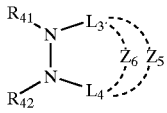

(Hy-3)

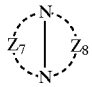

wherein $R_{39}$, $R_{40}$, $R_{41}$ and $R_{42}$, which are independent of each other, each represents an alkyl group, an alkenyl group, alkynyl group, an aryl group or a heterocyclic group, or $R_{39}$ and $R_{40}$, or $R_{41}$ and $R_{42}$ combine with each other to complete a ring; $Z_4$ represents an alkylene group containing 4, 5 or 6 carbon atoms; $Z_5$ represents an alkylene group containing 2 carbon atoms; $Z_6$ represents an alkylene group containing 1 or 2 carbon atoms; $Z_7$ and $Z_8$ each represents an alkylene group containing 3 carbon atoms; $L_3$ and $L_4$ each represents a methine group.

In formulae (Hy-1), (Hy-2) and (Hy-3) each, at least one substituent represented by —$(Q_1)_{k2}$—$(Het)_{k1}$ is present.

The compounds selected from those represented by formulae (Hy-1) and (Hy-2) respectively are preferable, and the compounds selected from those represented by formula (Hy-1) are advantageous in particular.

The compounds represented by formula (Hy-1) are illustrated below.

$R_{39}$ and $R_{40}$ each in formula (Hy-1) have the same meaning as $R_6$, $R_7$, $R_8$ and $R_9$ each has, and the suitable ranges thereof are also the same.

In particularly preferable cases, $R_{39}$ and $R_{40}$ are each an alkyl group, or $R_{39}$ and $R_{40}$ combine with each other to form an unsubstituted tetramethylene or pentamethylene group.

$Z_4$ represents an alkylene group containing 4, 5 or 6 carbon atoms, preferably an alkylene group containing 4 or 5 carbon atoms.

However, the carbon atom directly attached to the nitrogen atom of hydrazine has no oxo substituent.

The foregoing alkylene group may have no substituent or a certain substituent. This substituent includes the substituent Y recited hereinbefore. However, it is desirable that the carbon atom directly bonded to the nitrogen atom of hydrazine have the form of unsubstituted methylene.

It is particularly desirable for $Z_4$ to be an unsubstituted tetramethylene or pentamethylene group.

The hydrazine represented by formula (Hy-1) has at least one substituent represented by $—(Q_1)_{k2}—(Het)_{k1}$. This substituent may be located in any of $R_{39}$, $R_{40}$ and $Z_4$, preferably $R_{39}$ or $R_{40}$.

Then, the compounds represented by formula (Hy-2) are described in detail.

$R_{41}$ and $R_{42}$ each have the same meaning as $R_6$, $R_7$, $R_8$ and $R_9$ each has, and the suitable ranges thereof are also the same.

In particularly preferable cases, $R_{41}$ and $R_{42}$ are each an alkyl group, or $R_{41}$ and $R_{42}$ combine with each other to form a trimethylene group.

$Z_5$ represents an alkylene group containing 2 carbon atoms.

$Z_6$ represents an alkylene group containing 1 or 2 carbon atoms.

These alkylene groups each may have no substituent or a certain substituent. This substituent includes the substituent Y as recited hereinbefore.

Preferably, $Z_5$ is an unsubstituted ethylene group, and $Z_6$ is an unsubstituted methylene or ethylene group.

$L_3$ and $L_4$ each represents a substituted or unsubstituted methine group. $L_3$ and $L_4$ each may have, e.g. , the substituent Y as recited hereinbefore, preferably an unsubstituted alkyl group (such as methyl or t-butyl). Preferably, $L_3$ and $L_4$ are each an unsubstituted methine group.

The hydrazine represented by formula (Hy-2) has at least one substituent represented by $—(Q_1)_{k2}—(Het)_{k1}$. This substituent may be located in any of $R_{41}$, $R_{42}$, $Z_5$, $Z_6$, $L_3$ and $L_4$, preferably $R_{41}$ or $R_{42}$.

Further, the compounds represented by formula (Hy-3) are described in detail.

$Z_7$ and $Z_8$, which are independent of each other, each represents an alkylene group containing 3 carbon atoms.

However, the carbon atom directly attached to the nitrogen atom of hydrazine has no oxo substituent.

The foregoing alkylene group may have no substituent or a certain substituent. This substituent includes, e.g., the substituent Y as recited hereinbefore. However, it is desirable that the carbon atom directly attached to the nitrogen atom of hydrazine assume the form of unsubstituted methylene.

The alkylene group particularly preferred as $Z_7$ and $Z_8$ each is an unsubstituted trimethylene group or a substituted trimethylene group (such as 2,2-dimethyltrimethylene).

The hydrazine represented by formula (Hy-3) has at least one substituent represented by $—(Q_1)_{k2}—(Het)_{k1}$. This substituent may be located in either $Z_7$ or $Z_8$.

The moiety represented by Het in formula (III) has any of the structures (1) to (5) described below:

(1) A 5-, 6- or 7-membered heterocyclic structure containing at least 2 hetero atoms, (2) A 5-, 6- or 7-membered quaternary nitrogen-containing heterocyclic structure represented by the following formula A, (3) A 5-, 6- or 7-membered nitrogen-containing heterocyclic structure which has a thioxo group and is represented by the following formula B, (4) A 5-, 6- or 7-membered nitrogen-containing heterocyclic structure represented by the following formula C, and (5) A 5-, 6- or 7-membered nitrogen-containing heterocyclic structure represented by the following formula D or E.

A

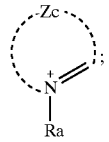

B

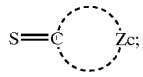

C

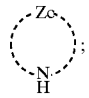

D

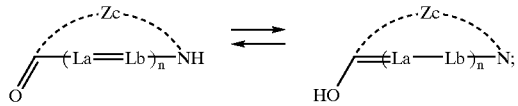

E

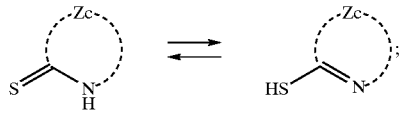

In the above formulae, Zc represents atoms completing a 5-, 6- or 7-membered nitrogen-containing hetero ring, Ra represents an aliphatic group, La and Lb each represents a methine group, and n represents 0, 1 or 2.

Suitable examples of an aliphatic group represented by Ra include the groups recited above as examples of alkyl, alkenyl and alkynyl groups which $R_6$, $R_7$, $R_8$ and $R_9$ each represents.

The nitrogen-containing hetero ring in which Zc is comprised as a ring constituent is a 5-, 6- or 7-membered hetero ring which contains at least one nitrogen atom and may further contain another hetero atom (e.g., oxygen, sulfur, selenium, tellurium). Suitable examples of such a hetero ring include azole rings (such as imidazole, triazole, tetrazole, oxazole, thiazole, selenazole, benzimidazole, benzotriazole, benzoxazole, benzothiazole, thiadiazole, oxadiazole, benzoselenazole, pyrazole, naphthothiazole, naphthimidazole, naphthoxazole, azabenzimidazole and purine), a pyrimidine ring, a triazine ring, and azaindene rings (such as triazaindene, tetrazaindene and pentazaindene).

Additionally, the moiety represented by Het has at least one substituent represented by $—(Q_1)_{k2}—(Hy)$.

The heterocyclic structures preferred as Het are those represented by the following formulae (Het-a), (Het-b), (Het-c), (Het-d) and (Het-e) respectively:

(Het-a)

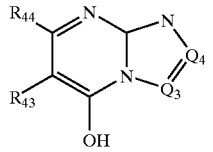

$Q_3$ = N, $Q_4$ = C—$R_{45}$; or $Q_3$ = C—$R_{45}$, $Q_4$ = N (Het-b)

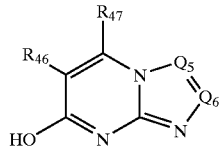

$Q_5$ = N, $Q_6$ = C—$R_{48}$; or $Q_5$ = C—$R_{48}$, $Q_6$ = N (Het-c)

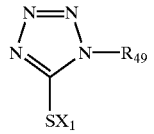

(Het-d)

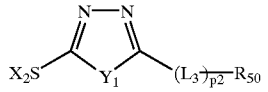

(Het-e)

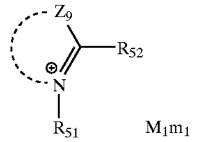

In the above formulae, $R_{43}$, $R_{44}$, $R_{45}$, $R_{46}$, $R_{47}$ and $R_{48}$, which are independent of each other, each represents a hydrogen atom or a monovalent substituent.

$R_{49}$ represents an alkyl group, an alkenyl group, an alkynyl group, an aryl group or a heterocyclic group.

$X_1$ represents a hydrogen atom, an alkali metal atom, an ammonium group, or a blocking group.

$Y_1$ represents an oxygen atom, a sulfur atom, >NH, or >N—$(L_4)p_3$—$R_{53}$, $L_3$ and $L_4$ each represents a linkage group, and $R_{50}$ and $R_{53}$ each represents a hydrogen atom, an alkyl group, an alkenyl group, an alkynyl group, an aryl group or a heterocyclic group.

$X_2$ has the same meaning as $X_1$.

$p_2$ and $p_3$ each represents an integer of from 0 to 3, preferably 1.

$Z_9$ represents atoms completing a 5- or 6-membered nitrogen-containing hetero ring.

$R_{51}$ represents an alkyl group, an alkenyl group or an alkynyl group.

$R_{52}$ represents a hydrogen atom, an alkyl group, an alkenyl group or an alkynyl group.

Additionally, each of the moieties represented by formulae (Het-a) to (Het-e) has at least one substituent represented by —$(Q_1)_{k2}$—(Hy). However, such a substituent is located neither in $X_1$ of formula (Het-c) nor in $X_2$ of formula (Het-d).

Of formulae (Het-a) to (Het-e), the formulae (Het-a), (Het-c) and (Het-d) are preferred over the others, and the formula (Het-c) is most advantageous.

Then, the formulae (Het-a) to (Het-e) are illustrated in further detail.

$R_{43}$, $R_{44}$, $R_{45}$, $R_{46}$, $R_{47}$ and $R_{48}$ each represents a hydrogen atom or a monovalent substituent. This monovalent substituent can include the groups which $R_6$, $R_7$, $R_8$ and $R_9$ each can represent, and those recited as the substituent Y.

Examples of a group preferred as the foregoing monovalent substituent include lower alkyl groups (preferably substituted or unsubstituted alkyl groups containing 1 to 4 carbon atoms, such as methyl, ethyl, n-propyl, isopropyl, n-butyl, t-butyl, methoxyethyl, hydroxyethyl, hydroxymethyl, vinyl and allyl), a carboxyl group, alkoxy groups (preferably substituted or unsubstituted alkoxy groups containing 1 to 5 carbon atoms, such as methoxy, ethoxy, methoxyethoxy and hydroxyethoxy), aralkyl groups (preferably substituted or unsubstituted aralkyl groups containing 7 to 12 carbon atoms, such as benzyl, phenetyl and phenylpropyl), aryl groups (preferably substituted or unsubstituted aryl groups containing 6 to 12 carbon atoms, such as phenyl, 4-methylphenyl and 4-methoxyphenyl), heterocyclic groups (such as 2-pyridyl), alkylthio groups (preferably substituted or unsubstituted alkylthio groups containing 1 to 10 carbon atoms, such as methylthio and ethylthio), arylthio groups (preferably substituted or unsubstituted arylthio groups containing 6 to 12 carbon atoms, such as phenylthio), aryloxy groups (preferably substituted or unsubstituted aryloxy groups containing 6 to 12 carbon atoms, such as phenoxy) alkylamino groups containing at least 3 carbon atoms (such as propylamino and butylamino), arylamino groups (such as anilino), halogen atoms (such as chlorine, bromine, fluorine), and the following substituents:

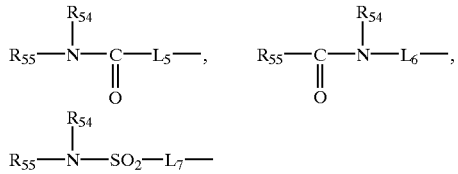

wherein $L_5$, $L_6$ and $L_7$ each represents an alkylene group as a linkage group (preferably those containing 1 to 5 carbon atoms, such as methylene, propylene and 2-hydroxypropylene); and $R_{54}$ and $R_{55}$, which may be the same or different, each represents a hydrogen atom, an alkyl, alkenyl or alkynyl group (preferably a 1–10C substituted or unsubstituted group, such as methyl, ethyl, n-propyl, isopropyl, n-butyl, t-butyl, n-octyl, methoxyethyl, hydroxyethyl, allyl or propargyl), an aralkyl group (preferably a substituted or unsubstituted aralkyl group containing 7 to 12 carbon atoms, such as benzyl, phenetyl or vinylbenzyl), an aryl group (preferably a substituted or unsubstituted aryl group containing 6 to 12 carbon atoms, such as phenyl or 4-methylphenyl) or a heterocyclic group (such as 2-pyridyl).

The alkyl, alkenyl, alkynyl, aryl and heterocyclic groups which $R_{49}$ can represent may have no substituent or a certain substituent. Examples of a substituent suitable for the group represented by $R_{49}$ include the groups represented by $R_6$, $R_7$, $R_8$ and $R_9$, and the substituents recited as Y.

As examples of a more suitable substituent for the group represented by $R_{49}$, mention may be made of a halogen atom (such as chlorine, bromine or fluorine), a nitro group, a cyano group, a hydroxyl group, an alkoxy group (such as methoxy), an aryl group (such as phenyl), an acylamino group (such as propionylamino), an alkoxycarbonylamino group (such as methoxycarbonylamino), an ureido group, an amino group, a heterocyclic group (such as 2-pyridyl), an acyl group (such as acetyl), a sulfamoyl group, a sulfonamido group, a thioureido group, a carbamoyl group, an alkylthio group (such as methylthio), an arylthio grouop (such as phenylthio), a heterocyclylthio group (such as 2-benzothiazolylthio), a carboxylic acid group, a carboxylate group, a sulfo group and a sulfonate group.

Each of the above-recited ureido, thioureido, sulfamoyl, carbamoyl and amino groups includes unsubstitued one, N-(alkyl-substituted) one and N-(aryl-substituted) one.

In the aryl group are included unsubstituted phenyl and substituted phenyl groups. The substituents which the phenyl group can have include the groups which $R_6$, $R_7$, $R_8$ and $R_9$ each can represent, and the groups recited as the substituent Y.

The alkali metal atom represented by $X_1$ and $X_2$ each is, e.g., sodium or potassium atom, and the ammonium group represented thereby is, e.g., tetramethylammonium or trimethylbenzylammonium. The blocking group represented by $X_1$ and $X_2$ each is a group capable of splitting off under an alkaline condition, such as acetyl, cyanoethyl or methanesulfonylethyl group.

Examples of a divalent linkage group represented by $L_3$ and $L_4$ each includes the following linkage groups and combinations of two or more of these groups:

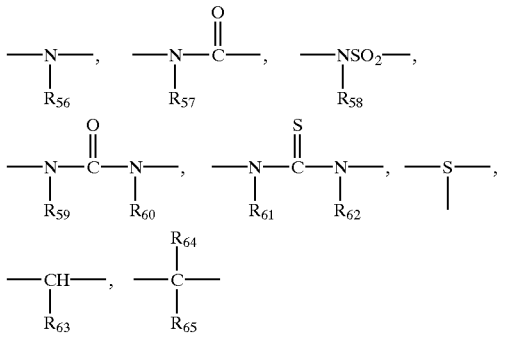

wherein $R_{56}$, $R_{57}$, $R_{58}$, $R_{59}$, $R_{60}$, $R_{61}$, $R_{62}$, $R_{63}$, $R_{64}$ and $R_{65}$, which are independent of each other, each represents a hydrogen atom, an alkyl, alkenyl or alkynyl group (preferably a substituted or unsubstituted 1–4C group, such as methyl, ethyl, n-butyl, methoxyethyl, hydroxyethyl or allyl), or an aralkyl group (preferably a substituted or unsubstituted 7–12C aralkyl group, such as benzyl, phenetyl or phenylpropyl).

The groups suitable for $R_{50}$ and $R_{53}$ each is similar to those recited above as examples of $R_{49}$.

Suitable examples of a hetero ring having $Z_9$ as a ring constituent include thiazoliums (such as thiazolium, 4-methylthiazolium, benzothiazolium, 5-methylbenzothiazolium, 5-chlorobenzothiazolium, 5-methoxybenzothiazolium, 6-methylbenzothiazolium, 6-methoxybenzothiazolium, naphtho-[1,2-d]thiazolium and naphtho[2,1-d]thiazolium), oxazoliums (such as oxazolium, 4-methyloxazolium, benzoxazolium, 5-chlorobenzoxazolium, 5-phenylbenzoxazolium, 5-methylblenzoxazolium or naphtho[1,2-d]oxazolium), imidazoliums (such as 1-methylbenzimidazolium, 1-propyl-5-chloro-benzimidazolium, 1-ethyl-5,6-cyclobenzimidazolium and 1-allyl-5-trifluoromethyl-6-chlorobenzimidazolium), and selenazoliums (such as benzoselenazolium, 5-chlorobenzoselenazolium, 5-methylbenzoselenazolium, 5-methoxybenzoselenazolium and naphtho[1,2-d]selenazolium).

Of these hetero rings, thiazoliums (such as benzothiazolium, 5-chlorobenzothiazolium, 5-methoxybenzothiazolium and naphtho[1,2-d]thiazolium) are preferred over the others.

Suitable examples of $R_{51}$ and $R_{52}$ each includes a hydrogen atom, unsubstituted 1–18C alkyl groups (such as methyl, ethyl, propyl, butyl, pentyl, octyl, decyl, dodecyl and octadecyl), substituted alkyl groups (which can have as a substituent, e.g , a vinyl group, a carboxyl group, a sulfo group, a cyano group or a halogen atom (such as fluorine, chlorine or bromine)), a hydroxyl group, 1–8C alkoxycarbonyl groups (such as methoxycarbonyl, ethoxycarbonyl, phenoxycarbonyl and benzyloxycarbonyl), 1–8C alkoxy groups (such as methoxy, ethoxy, benzyloxy and phenetyloxy), 6–10C monocyclic aryloxy groups (such as phenoxy and p-tollyloxy), 1–3C acyloxy groups (such as acetyloxy and propionyloxy), 1–8C acyl groups (such as acetyl, propionyl, benzoyl and mesyl), carbamoyl groups (such as carbamoyl, N,N-dimethylcarbamoyl, morpholinocarbonyl and piperidinocarbonyl), sulfamoyl groups (such as sulfamoyl, N,N-dimethylsulfamoyl, morpholinosulfonyl and piperidinosulfonyl) and 1–18C alkyl groups substituted by 6–10C aryl groups (such as phenyl, 4-chlorophenyl, 4-methylphenyl and α-naphthyl). However, the case where $R_{51}$ is a hydrogen atom is excluded therefrom.

Preferably, $R_{51}$ is an unsubstituted alkyl group (such as methyl or ethyl) or an alkenyl group (such as allyl), and $R_{52}$ is a hydrogen atom or an unsubstituted lower alkyl group (such as methyl or ethyl).

$M_1$ and $m_1$ are contained in formula (Het-e) in order to show whether the presence of cation or anion is required or not for neutralizing the ionic charge on the compound represented by formula (Het-e). Whether some dye bears a cation or an anion or no net ionic charge depends on its auxochrome and substituents. The typical cations are inorganic or organic ammonium ions and alkali metal ions, while the anions may be inorganic or organic ones. Examples of an anion usable for $M_1$ include halide ions (such as fluoride, chloride, bromide and iodide ions), substituted arylsulfonate ions (such as p-toluenesulfonate ion and p-chlorobenzenesulfonate ion), aryldisulfonate ions (such as 1,3-benzenedisulfonate ion, 1,5-naphthalenedisulfonate ion and 2,6-naphthalenedisulfonate ion), alkylsulfate ions (such as methylsulfate ion), sulfate ion, thiocyanate ion, perchlorate ion, tetrafluoroborate ion, picrate ion, acetate ion and trifluoromethanesulfonate ion.

Of these cations and anions, ammonium ion, iodide ion, bromide ion and p-toluenesulfonate ion are preferred over the others.

Each of the nitrogen-containing hetero rings represented by formulae (Het-a) to (Het-e) has at least one substitutent represented by $—(Q_1)_{k2}—(Hy)$. This substituent can be located in $R_{43}$, $R_{44}$, $R_{45}$, $R_{46}$, $R_{47}$, $R_{48}$, $R_{49}$, $R_{50}$, $R_{51}$, $Y_1$, $L_3$ or $Z_9$.

$Q_1$ in formula (III) represents a divalent linkage group comprising at least one atom or atoms selected from among carbon, nitrogen, sulfur and oxygen atoms.

Preferably, $Q_1$ represents a 1–8C alkylene group (such as methylene, ethylene, propylene, butylene or pentylene), a 6–12C arylene group (such as phenylene or naphthylene), a 2–8C alkenylene group (such as ethenylene or propenylene), an amide linkage, an ester linkage, a sulfamide linkage, a sulfonate linkage, an ureide linkage, a sulfonyl group, a sulfinyl group, a thioether linkage, an ether linkage, a carbonyl group, $—N(R_0)—$ (wherein $R_0$ is a hydrogen atom, a substituted or unsubstituted alkyl group, or a substituted or unsubstituted aryl group), a divalent hetro ring residue (such as 6-chloro-1,3,5-triazizne-2,4-diyl, pyrimidine-2,4-diyl or quinoxaline-2,3-diyl), or a 4–20C divalent linkage group constituted of two or more of the above-recited ones. Of these linkage groups, ureide, ester and amide linkages are preferred over the others.

In formula (III), it is desirable that k1 and k3 be each 1 or 2. Preferably, all of k1, k2 and k3 are 1.

When k1 or k3 is at least 2, one Hy or Het may be the same as or different from another Hy or Het.

Of the present compounds represented by formula (III) the compounds represented by the following formulae (III-A), (III-B), (III-C), (III-D) and (III-E) respectively are preferable:

(III-A)

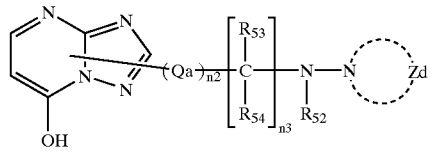

(III-B)

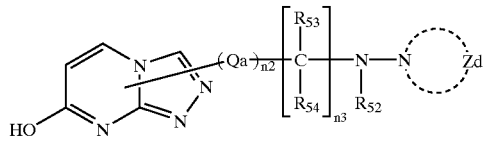

(III-C)

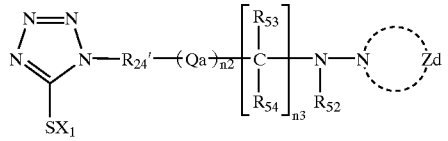

$R_{24}'$: alkylene, arylene or divalent heterocyclic residue (III-D)

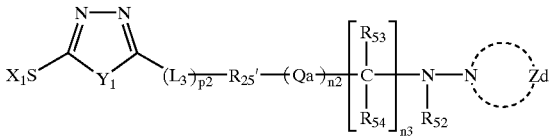

$R_{25}'$: same as $R_{24}'$ (III-E)

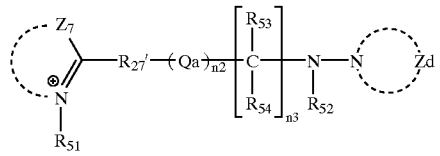

$R_{27}'$: alkylene

In the invention, the compounds represented by the following formula (III-F) are preferred in particular:

(III-F)

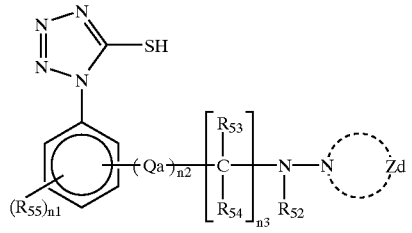

In the above formulae, Qa has the same meaning as $Q_1$ in formula (III), Zd has the same meaning as $Z_4$ in formula (Hy-1), $R_{55}$ represents a monovalent substituent, $R_{52}$ represents an alkyl group, an alkenyl group, an alkynyl group, an aryl group or a heterocyclic group, $R_{53}$ and $R_{54}$ each represents a hydrogen atom or a monovalent substituent, $n_1$ represents an integer of from 0 to 4, $n_2$ represents 0 or 1, $n_3$ represents an integer of from 1 to 6, $X_1$ has the same meaning as $X_1$ in formula (Het-c), $Y_1$ $L_3$ and $p_3$ have the same meanings as $Y_1$, $L_3$ and $p_3$ in formula (Het-d) respectively, and $R_{51}$ has the same meaning as $R_{51}$ in formula (Het-e).

When $n_1$ and $n_3$ are each at least 2, it is not required for one $R_{55}$ and one —C($R_{53}$) ($R_{54}$)— to be the same as another $R_{55}$ and another —C($R_{53}$) ($R_{54}$)— respectively.

In more detail, the linkage groups suitable for $Q_1$ in formula (III) are suitable for Qa also. In particular, it is advantageous that Qa be an ureide, ester or amide linkage.

The groups suitable for Zd are the same as those suitable for $Z_4$ in formula (Hy-1), preferably unsubstituted tetramethylene and pentamethylene groups.

The groups suitable for $R_{55}$ are the same as those suitable for $R_{43}$.

The groups suitable for $R_{52}$ are the same as those suitable for $R_6$, $R_7$, $R_8$ and $R_9$ each, particularly unsubstituted 1–4C alkyl groups (such as methyl and ethyl).

The groups suitable for $R_{53}$ and $R_{54}$ each are the same as those suitable for $R_{43}$. In particular, hydrogen atom is preferred as $R_{53}$ and $R_{54}$ each.

$n_1$ is preferably 0 or 1, $n_2$ is preferably 1, and $n_3$ is preferably 2 to 4.

Typical examples of the present compounds represented by formula (III) are illustrated below. However, these examples should not be construed as limiting the scope of the invention.

III-1

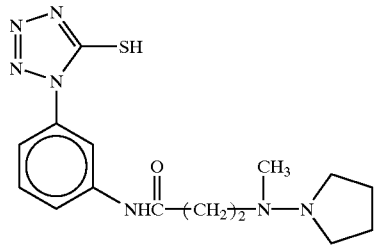

III-2

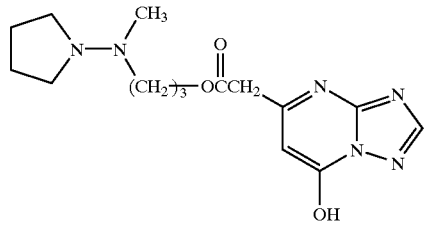

III-3

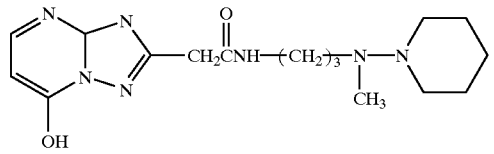

III-4

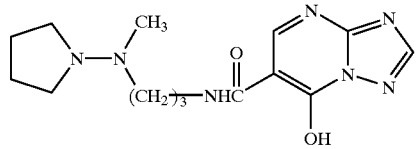

-continued

III-5

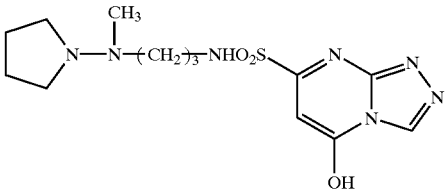

III-6

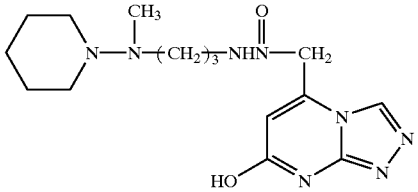

III-7

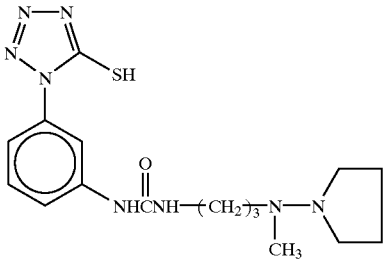

III-8

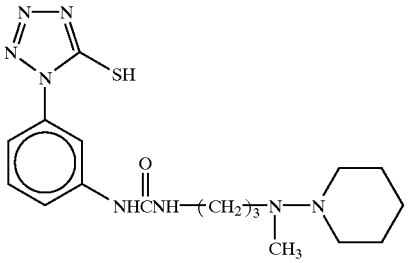

III-9

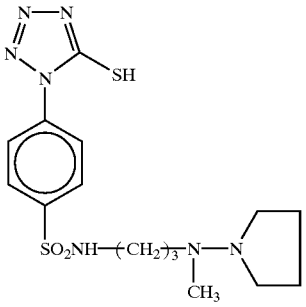

III-10

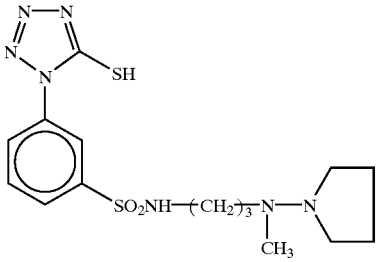

-continued

III-11

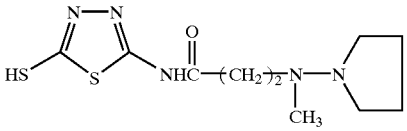

III-12

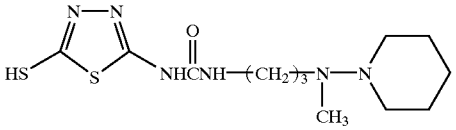

III-13

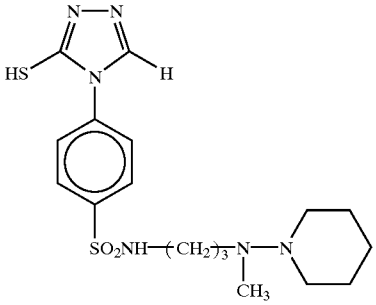

III-14

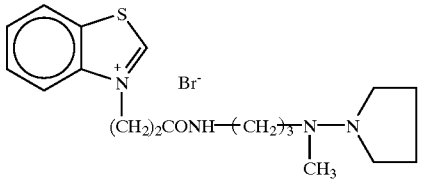

III-15

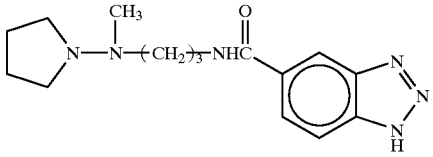

III-16

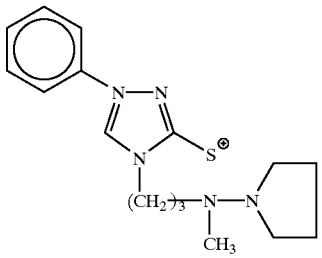

The Het moiety in formula (III) usable in the invention includes those disclosed in U.S. Pat. No. 3,266,897, Belgian Patent 671,402, JP-A-60-138548, JP-A-59-68732, JP-A-59-123838, JP-B-58-9939, JP-A-59-137951, JP-A-57-202531, JP-A-57-164734, JP-A-57-14836, JP-A-57-116340, U.S. Pat. No. 4,418,140, JP-A-58-95728, JP-A-55-79436, West German Patent Application (OLS) 2,205,029, West German Patent Application (OLS) 1,962,605, JP-A-55-59463, JP-B-48-18257, JP-B-53-28084, JP-A-53-48723, JP-B-59-52414, JP-A-58-21798, JP-B-49-8334, U.S. Pat. Nos. 3,598,602, 887,009, U.K. Patent 965,047, Belgian Patent 737,809, U.S. Pat. No. 3,622,340, JP-A-60-87322, JP-A-57-211142, JP-A-58-158631, JP-A-59-15240, U.S. Pat. No. 3,671,255, JP-B-48-34166, JP-B-48-322112, JP-A-58-221839, JP-B-48-

32367, JP-A-60-130731, JP-A-60-122936, JP-A-60-117240, U.S. Pat. No. 3,228,770, JP-B-43-13496, JP-B-43-10256, JP-B-47-8725, JP-B-47-30206, JP-B-47-4417, JP-B-51-25340, U.K. Patent 1,165,075, U.S. Pat. Nos. 3,512,982, 1,472,845, JP-B-39-22067, JP-B-39-22068, U.S. Pat. Nos. 3,148,067, 3,759,901, 3,909,268, JP-B-50-40665, JP-B-39-2829, U.S. Pat. No. 3,148,066, JP-B-45-22190, U.S. Pat. No. 1,399,449, U.K. Patent 1,287,284, U.S. Pat. No. 3,900,321, 3,655,391, 3,910,792, U.K. Patent 1,064,805, U.S. Pat. Nos. 3,544,336, 4,003,746, U.K. Patent 1,344,525, U.K. Patent 972,211, JP-B-43-4136, U.S. Pat. No. 3,140,178, French Patent 2,015,456, U.S. Pat. No. 3,114,637, Belgian Patent 681,359, U.S Pat. No. 3,220,839, U.K. Patent 1,290,868, U.S Pat. Nos. 3,137,578, 3,420,670, 2,759,908, 3,622,340, West German Patent Application (OLS) 2,501,261, West German Patent (DT-AS) 1,772,424, U.S. Pat. No. 3,157,509, French Patent 1,351,234, U.S. Pat. No. 3,630,745, French Patent 2,005,204, German Patent 1,447,796, U.S. Pat. No. 3,915,710, JP-B-49-8334, U.K. Patent 1,021,199, U.K. Patent 919,061, JP-B-46-17513, U.S. Pat. No. 3,202,512, West German Patent Application (OLS) 2,553,127, JP-A-50-104927, French Patent 1,467,510, U.S. Pat. Nos. 3,449,126, 3,503,936, 3,576,638, French Patent 2,093,209, U.K. Patent 1,246,311, U.S. Pat. Nos. 3,844,788, 3,535,115, U.K. Patent 1,161,264, U.S. Pat. Nos. 3,841,878, 3,615,616, JP-A-48-39039, U.K. Patent 1,249,077, JP-B-48-34166, U.S. Pat. No. 3,671,255, U.K. Patent 1,459,160, JP-A-50-6323, U.K. Patent 1,402,819, West German Patent Application (OLS) 2,031,314, *Research Disclosure*, No. 13651, U.S. Pat. Nos. 3,910,791, 3,954,478, 3,813,249, U.K. Patent 1,387,654, JP-A-57-135945, JP-A-57-96331, JP-A-57-22234, JP-A-59-26731, West German Patent Application (OLS) 2,217,153, U.K. Patent 1,394,371, U.K. Patent 1,308,777, U.K. Patent 1,389,089, U.K. Patent 1,347,544, German Patent 1,107,508, U.S. Pat. No. 3,386,831, U.K. Patent 1,129,623, JP-A-49-14120, JP-B-46-34675, JP-A-50-43923, U.S. Pat. No. 3,642,481, U.K. Patent 1,269,268, U.S. Pat. Nos. 3,128,185, 3,295,981, 3,396,023, 2,895,827, JP-B-48-38418, JP-A-48-47335, JP-A-50-87028, U.S. Pat. Nos. 3,236,652, 3,443,951, U.K. Patent 1,065,669, U.S. Pat. Nos. 3,312,552, 3,310,405, 3,300,312, U.K. Patent 952,162, U.K. Patent 948,442, JP-A-49-120628, JP-B-48-35372, JP-B-47-5315, JP-A-39-18706, JP-A-43-4941 and JP-A-59-34530. The Het moiety according to the invention can be synthesized by reference to the literature cited above.

The Hy moiety in formula (III) usable in the invention can be synthesized using various methods. For instance, it can be synthesized by the method of alkylating hydrazine. As to the alkylation method, there are known the method of alkylating hydrazine by substitution with a halogenated alkane and alkyl sulfonate, the reductive alkylation method using a carbonyl compound and a sodium cyanoborohydride, and the method of acylating hydrazine and then reducing the acylated hydrazine by the use of lithium aluminum hydride. These methods are described in S. R. Sandler & W. Karo, *Organic Functional Group Preparation*, vol. 1, chap. 14, pp. 434–465, Academic Press (1968), and E. L. Clennan et al., *Journal of The American Chemical Society*, vol. 112, No. 13, p. 5080 (1990). The desired compounds can be synthesized by reference to the literature cited above.

The linkage-forming reaction in the $—(Q_1)_{k2}—(Hy)$ moiety, including the amide linkage- and ester linkage-forming reactions, can be effected utilizing the methods well known in organic chemistry. More specifically, the linkage formation can be carried out using a method properly selected from known methods, including the method of linking Het and Hy together, the method of linking Hy to a starting material and an intermediate of Het synthesis and then synthesizing the Het, and the method of linking a starting material and an intermediate of Hy synthesis to the Het moiety and then synthesizing Hy. For details of the synthesis reaction for the foregoing linkage formation, many books on organic synthesis reactions, e.g., *Shin Jikken Kagaku Koza* 14 (New Lectures on Experimental Chemistry, vol. 14, entitled "Syntheses and Reactions of Organic Compounds"), Nos. I–V, compiled by Japanese Chemical Society, published by Maruzen, Tokyo (1977), Yoshiro Ogata, *Yuki Hannoron* (Theory of Organic Reactions), Maruzen, Tokyo (1962), and L. F. Fieser & M. Fieser, *Advanced Organic Chemistry*, Maruzen, Tokyo (1962), can be referred to.

More concretely, the linkage can be formed using the method described in Examples 1 and 2 of JP-A-7-135341.

When the compounds represented by formula (III) are added during the process of making emulsions, the addition may be carried out at any stage of the process. For instance, these compounds can be added to emulsions at the stage of forming silver halide grains, before the desalting stage begins, at the desalting stage, before the chemical ripening starts, at the chemical ripening stage, or before the finished emulsion is prepared. Additionally, the addition of the compound(s) may be portioned out to some different stages.

In adding the present compounds represented by formula (III), it is desirable for them to be dissolved in water, a water-soluble solvent, such as methanol or ethanol, or a mixture of these solvents. In a case where those compounds are dissolved in water and their solubilities in water can be raised by heightening or lowering the pH, it is favorable to dissolve them in the water adjusted to a high or low pH value respectively and add the resulting solution.

It is desirable to use the compounds represented by formula (III) in an emulsion layer. While the compounds may be added directly to the emulsion layer, they may be added to a coating solution for a protective layer or an interlayer and dispersed into the emulsion layer at the time the coating solution is applied.

It does not matter whether the compounds represented by formula (III) are added before or after sensitizing dyes are added. Their suitable content in a silver halide emulsion layer is from $1\times10^{-9}$ to $5\times10^{-2}$ mole, preferably from $1\times10^{-8}$ to $2\times10^{-3}$ mole, per mole of silver halide.

Then, the compounds represented by formulae (IV-1) and (IV-2) respectively are illustrated in detail.

Examples of a substituent represented by $R_{10}$, $R_{11}$, $R_{12}$ and $R_{13}$ each in formula (IV-1) include alkyl groups (containing preferably 1 to 30, particularly preferably 1 to 20, carbon atoms, such as methyl, ethyl and isopropyl), aralkyl groups (containing preferably 7 to 30, particularly preferably 7 to 20, carbon atoms, such as phenylmethyl), alkenyl groups (containing preferably 2 to 20, particularly preferably 2 to 10, carbon atoms, such as allyl), alkoxy groups (containing preferably 1 to 20, particularly preferably 1 to 10, carbon atoms, such as methoxy and ethoxy), aryl groups (containing preferably 6 to 30, particularly preferably 6 to 20, carbon atoms), acylamino groups (containing preferably 2 to 30, particularly preferably 2 to 20, carbon atoms, such as acetylamino), sulfonylamino groups (containing preferably 1 to 30, particularly preferably 1 to 20, carbon atoms, such as methanesulfonylamino), ureido groups (containing preferably 1 to 30, particularly preferably 1 to 20, carbon atoms, such as methylureido), alkoxycarbonylamino groups (containing preferably 2 to 30, particularly preferably 2 to 20, carbon atoms, such as methoxycarbonylamino), aryloxycarbonylamino groups (containing preferably 7 to 30, particularly preferably 7 to 20, carbon atoms, such as phenyloxycarbonylamino), aryloxy groups (containing preferably 6 to 30, particularly preferably 6 to 20, carbon atoms, such as phenyloxy), sulfamoyl groups (containing preferably 0 to 30, particularly preferably 0 to 20, carbon atoms, such as methylsulfamoyl), carbamoyl groups (containing preferably 1 to 30, particularly preferably 1 to 20, carbon atoms, such as carbamoyl and methylcarbamoyl), a mercapto group, alkylthio groups (containing preferably 1 to 30, particularly preferably 1 to 20, carbon atoms, such as methylthio and carboxymethylthio), arylthio groups (containing preferably 6 to 30, particularly preferably 6 to 20, carbon atoms, such as phenylthio), sulfonyl groups (containing preferably 1 to 30, particularly preferably 1 to 20, carbon atoms, such as methanesulfonyl), sulfinyl groups (containing preferably 1 to 30, particularly preferably 1 to 20, carbon atoms, such as methanesulfonyl), a hydroxyl group, halogen atoms (such as chlorine, bromine and fluorine atoms), a cyano group, a sulfo group, a carboxyl group, a phosphono group, amino groups (containing preferably 0 to 30, particularly preferably 1 to 20, carbon atoms, such as methylamino), aryloxycarbonyl groups (containing preferably 7 to 30, particularly preferably 7 to 20, carbon atoms), acyl groups (containing preferably 2 to 30, particularly preferably 2 to 20, carbon atoms, such as acetyl and benzoyl), alkoxycarbonyl groups (containing preferably 2 to 30, particularly preferably 2 to 20, carbon atoms, such as methoxycarbonyl), acyloxy groups (containing preferably2 to 30, particularly preferably 2 to 20, carbon atoms, such as acetoxy), a nitro group, a hydroxamic acid group, and heterocyclic groups (such as pyridyl, furyl and thienyl). Additionally, these substituents may further be substituted.

As suitable examples of a substituent represented by $R_{10}$, $R_{11}$, $R_{12}$ and $R_{13}$ each, mention may be made of an alkyl group, an alkoxy group, a hydroxyl group, a halogen atom, a sulfo group, a carboxyl group, an acylamino group, a sulfonylamino group, an ureido group, an alkoxycarbonylamino group, an aryloxycarbonylamino group, an alkylthio group, an arylthio group, an amino group and an acyloxy group. Preferably, they each represents an alkyl group, an alkoxy group, a halogen atom, a sulfo group, a carboxyl group, an acylamino group, a sulfonylamino group, an ureido group, an alkoxycarbonylamino group or an aryloxycarbonylamino group. In particular, it is advantageous for them each to be an alkyl group, a halogen atom, an acylamino group, a sulfonylamino group, an ureido group, an alkoxycarbonylamino group or an aryloxycarbonylamino group.

It is desirable for $R_{10}$, $R_{11}$, $R_{12}$ and $R_{13}$ that one to three among them be each a hydrogen atom. Preferably, two or three among them are each a hydrogen atom. In particular, it is advantageous that three among them be each a hydrogen atom.

When both $R_{10}$ and $R_{13}$ are alkyl groups, these alkyl groups are required to differ in the number of carbon atoms. For instance, it is an allowable case that $R_{10}$ is t—$C_8H_{17}$ and $R_{13}$ is n—$C_{15}H_{31}$, but the case that both $R_{10}$ and $R_{13}$ are, e.g., t—$C_8H_{17}$ is excluded. When $R_{10}$ and $R_{13}$ are substituents of the same type, the carbon number difference between them is preferably at least 5, particularly preferably at least 10. These restrictions imposed on the relation between $R_{10}$ and $R_{13}$ apply also to the relation between $R_{11}$ and $R_{12}$.

Of the compounds represented by formula (IV-1), the compounds represented by the following formula (IV-1-a) are desirable, those represented by the following formula (IV-1-b) are more desirable, and those represented by the following formula (IV-1-c) are most desirable.

(IV-1-a)

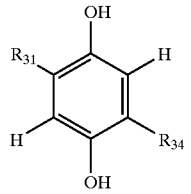

$R_{31}$ and $R_{34}$ in the above formula have the same meanings as $R_{10}$ and $R_{13}$ in formula (IV-1) respectively, and the desirable range of them is the same as that of $R_{10}$ and $R_{13}$.

(IV-1-b)

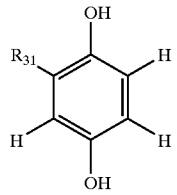

$R_{31}$ in the above formula have the same meaning as $R_{10}$ in formula (IV-1), and the desirable range thereof is the same as that of $R_{10}$.

(IV-1-c)

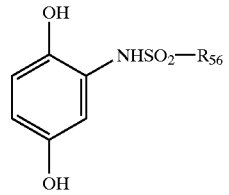

$R_{56}$ in the above formula is an unsubstituted or substituted alkyl group. To substituent(s) of this alkyl group can be applied those recited as examples of a substituent represented by $R_{10}$.

As examples of a substituent represented by $R_{14}$, $R_{15}$ and $R_{16}$ each in formula (IV-2), mention may be made of the substituents which the substituent represented by $R_{10}$, $R_{11}$, $R_{12}$ and $R_{13}$ each may have.

Suitable examples of a substituent represented by $R_{14}$ include an alkyl group, an alkoxy group, a hydroxyl group, a halogen atom, a sulfo group, a carboxyl group, an acylamino group, a sulfonylamino group, an ureido group, an alkoxycarbonylamino group, an aryloxycarbonylamino group, an alkylthio group, an arylthio group, an amino group and an acyloxy group. Preferably, $R_{14}$ represents an alkyl group, an alkoxy group, a halogen atom, a sulfo group, a carboxyl group, an acylamino group, a sulfonylamino group, an ureido group, an alkoxycarbonylamino group or an aryloxycarbonylamino group. In particular, it is advantageous for $R_{14}$ to be an alkyl group, a halogen atom, an acylamino group, a sulfonylamino group, an ureido group, an alkoxycarbonylamino group or an aryloxycarbonylamino group.

Suitable examples of a substituent represented by $R_{15}$ include an alkyl group, an alkoxy group, a hydroxyl group, a halogen atom, an acylamino group, a sulfonylamino group, an ureido group, an alkoxycarbonylamino group, an aryloxycarbonylamino group, an alkylthio group, an arylthio group, an amino group and an acyloxy group. Preferably, $R_{15}$ represents an alkyl group, an alkoxy group, a hydroxyl group, an acylamino group, a sulfonylamino group, an ureido group, an alkoxycarbonylamino group or an aryloxycarbonylamino group. In particular, it is advantageous for $R_{15}$ to be an alkyl group, an acylamino group, a sulfonylamino group, an ureido group, an alkoxycarbonylamino group or an aryloxycarbonylamino group.

Suitable examples of a substituent represented by $R_{16}$ include an alkyl group, an alkoxy group, a hydroxyl group, a halogen atom, a sulfo group, a carboxyl group, an acylamino group, a sulfonylamino group, an ureido group, an alkoxycarbonylamino group, an aryloxycarbonylamino group, an alkylthio group, an arylthio group, an amino group and an acyloxy group. Preferably, $R_{16}$ represents an alkyl group, an alkoxy group, a halogen atom, a sulfo group, a carboxyl group, an acylamino group, a sulfonylamino group, an ureido group, an alkoxycarbonylamino group or an aryloxycarbonylamino group. In particular, it is advantageous for $R_{16}$ to be an alkyl group.

Z represents nonmetal atoms completing a 4- to 6-membered ring. Suitable examples of nonmetal atoms include carbon, oxygen, nitrogen and sulfur atoms. It is desirable that the nonmetal atoms include carbon and oxygen atoms. In particular, carbon atoms are preferred as the nonmetal atoms. The number of ring members is preferably 5 or 6, particularly preferably 6. These rings each may have one or more of a substituent thereon. To such a substituent can be applied, e.g., those recited as examples of a substituent represented by $R_{14}$. Suitable examples of a substituent on the ring include an alkyl group, an alkenyl group and an alkoxy group. Of these groups, the alkyl group and the alkenyl group are preferred to the alkoxy group. These substituents may further be substituted.

Of the compounds represented by formula (IV-2), the preferable compounds are those represented by the following formula (IV-2-a), and the particularly preferable compounds are those represented by the following formula (IV-2-b).

(IV-2-a)

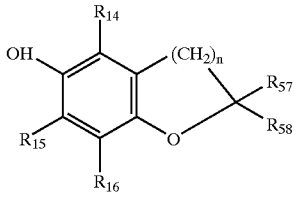

$R_{14}$, $R_{15}$ and $R_{16}$ in the above formula have the same meanings as those in formula (IV-2) respectively, and the desirable ranges thereof are the same as those in formula (IV-2) respectively. n represents 1 or 2. $R_{57}$ and $R_{58}$ each represents an alkyl group, an alkenyl group or an alkoxy group.

(IV-2-b)

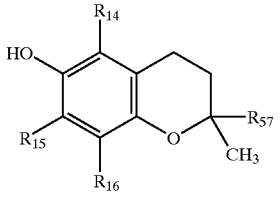

$R_{14}$, $R_{15}$and $R_{16}$ in the above formula have the same meanings as those in formula (IV-2) respectively, and the desirable ranges thereof are the same as those in formula (IV-2) respectively. $R_{57}$ represents an alkyl group, an alkenyl group or an alkoxy group. n is preferably 2.

The alkyl group and the alkenyl group which $R_{57}$ and $R_{58}$ each can represent may have any of straight-chain, branched and cyclic forms, preferably a straight-chain or branched form. The suitable number of carbon atoms contained therein is from 1 to 30, preferably from 1 to 20. Methyl, ethyl and isopropyl groups are examples of such an alkyl group, and allyl group is an example of such an alkenyl group.

The alkyl moiety of the alkoxy group represented by $R_{57}$ and $R_{58}$ each may have any of straight-chain, branched and cyclic forms, and $R_{57}$ and $R_{58}$ may combine with each other to form a ring, such as spirochromans. The suitable number of carbon atoms in the alkoxy group is from 1 to 20, preferably from 1 to 10. The alkoxy group represented by $R_{57}$ and $R_{58}$ each is, e.g., a methoxy or ethoxy group.

Examples of compounds represented by formulae (IV-1) and (IV-2) respectively are illustrated below, but these examples should not be construed as limiting the scope of the invention.

IV-1-1

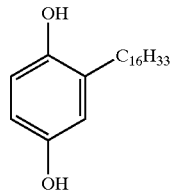

IV-1-2

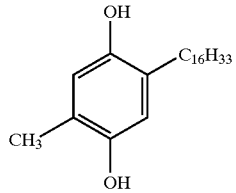

IV-1-3

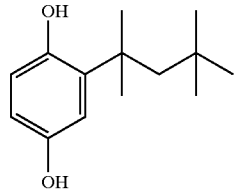

IV-1-4

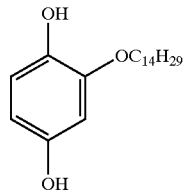

IV-1-5

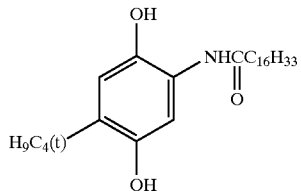

-continued
IV-1-6
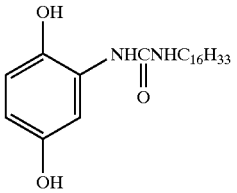
IV-1-7
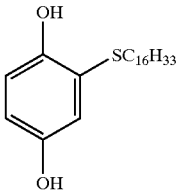
IV-1-8
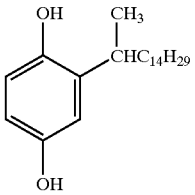
IV-1-9
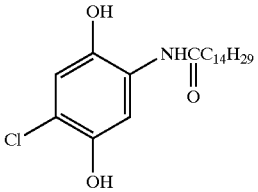
IV-1-10
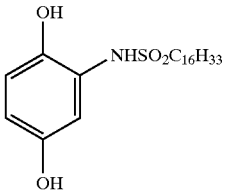
IV-1-11
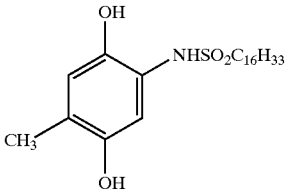
IV-1-12
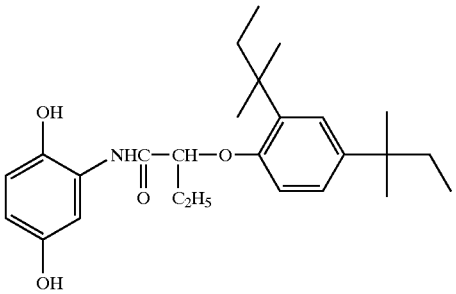
-continued
IV-1-13
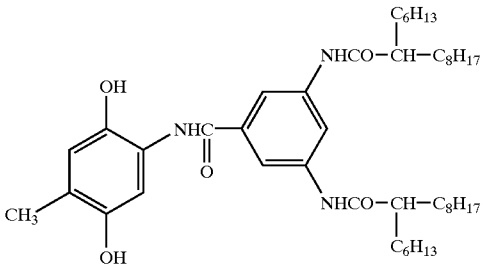
IV-1-14
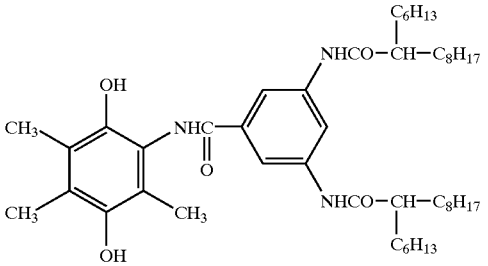
IV-1-15
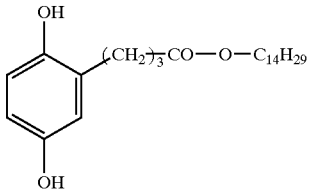
IV-1-16
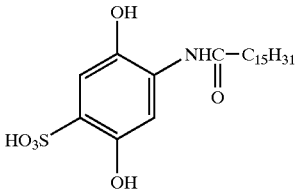
IV-1-17
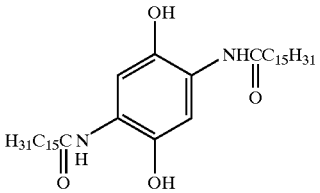
IV-1-18
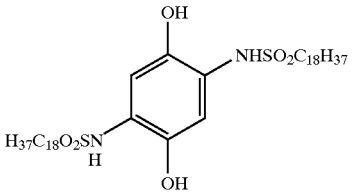
IV-1-19
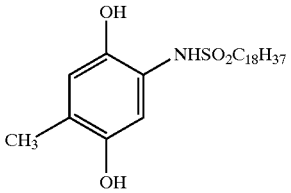

-continued

IV-1-20

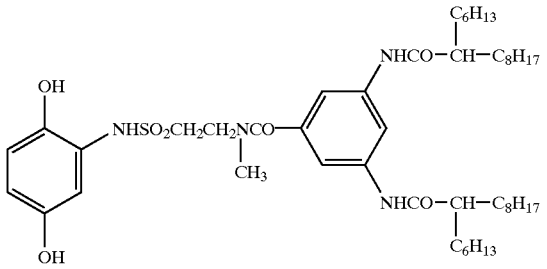

IV-1-21

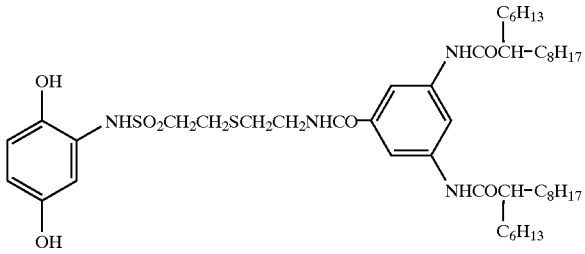

IV-1-22

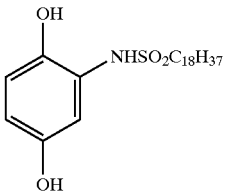

IV-2-1

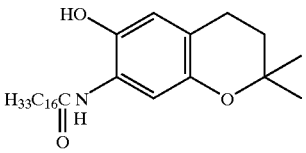

IV-2-2

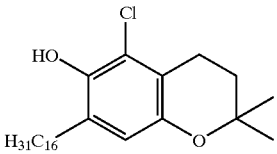

IV-2-3

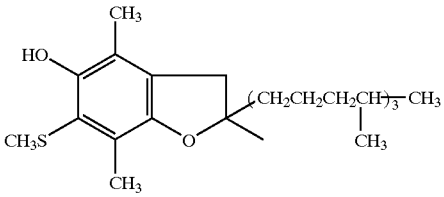

IV-2-4

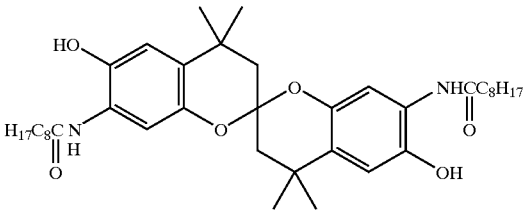

The compounds represented by formula (IV) can be synthesized using the methods described, e.g., in U.S. Pat. Nos. 2,728,659, 2,549,118 and 2,732,300, *Journal of American Chemical Society*, vol. 111, No. 20, p. 7932 (1989), Synthesis, vol. 12, p. 1549 (1995), *Q. J. Pharm. Pharmacol.*, vol. 17, p. 325 (1944), *Chem. Pharm. Bull.*, vol. 14, p. 1052 (1966), and *Chem. Pharm. Bull.*, vol. 16, p. 853 (1968).

In addition, the compounds represented by formula (IV) can also be synthesized using the methods disclosed, e.g., in U.S. Pat. Nos. 2,421,811, 2,421,812, 2,411,967 and 2,681, 371, *J. Amer. Chem. Soc.*, 65, 1943, 1276, *J. Amer. Chem. Soc.*, 65, 1943, 1281, *J. Amer. Chem. Soc.*, 63, 1941, 1887, *J. Amer. Chem. Soc.*, 107, 24, 1985, 7053, *Helv. Chim. Acta.*, 21, 1938, 939, *Helv. Chim. Acta.*, 28, 1945, 436, *Chem. Ber.* 71, 1938, 2637, *J. Or. Chem.*, 4, 1939, 311, *J. Or. Chem.*, 6, 1941, 229, *J. Chem. Soc.*, 1938,1382, *Helv. Chim. Acta.*, 21 1931,1234, *Tetrahedron Lett.*, 33, 26, 1992, 3795, *J. chem. Soc. Perkin. Trans.*, 1, 1981, 1437, and *Synthesis*, 6, 1995, 693.

It is desirable that the present compounds represented by formulae (IV-1) and (IV-2) each be dispersedin an emulsified condition by the use of a known dispersion method and then added. At the time they are dispersed in an emulsified condition, the additives generally used in the photographic art, such as dye-forming couplers and high boiling organic solvents, can be present together with them. In addition, they can also be added as a microcrystalline dispersion.

The present compounds represented by formulae (IV-1) and (IV-2) each are added to an emulsion layer in an amount of $5\times10^{-4}$ to 1 mole, preferably $1\times10^{-3}$ to $5\times10^{-1}$ mole, per mole of silver halide in the emulsion layer.

As to the combinations of the compounds of formula (III) with the compounds of formula (IV-1) or (IV-2), the combinations of the compounds of formula (III-F) with the compounds of formula (IV-1-b) or (IV-2-b) are preferred over the others.

Further, the compounds represented by formulae (V-1) to (V-3) respectively are illustrated in more detail.

The term "alkyl group" as used herein is intended to include straight-chain, branched and cyclic alkyl groups, and further these alkyl groups may be substituted.

$Ra_1$ in formula (V-1) represents an alkyl group (preferably a 1–13C alkyl group, such as methyl, ethyl, isopropyl, cyclopropyl, butyl, isobutyl, cyclohexyl, t-octyl, decyl, dodecyl, hexadecyl or benzyl), an alkenyl group (preferably a 2–14C alkenyl group, such as allyl, 2-butenyl, isopropenyl, oleyl or vinyl) or an aryl group (preferably a 6–14C aryl group, such as phenyl or naphthyl) $Ra_2$ represents a hydrogen atom or a group represented by $Ra_1$. $Ra_3$ represents a hydrogen atom, a substituted or unsubstituted 1–10C alkyl group (such as methyl, isobutyl or cyclohexyl) or an alkenyl group (such as vinyl or isopropenyl). The total number of carbon atoms contained in $Ra_1$, $Ra_2$ and $Ra_3$ is at most 20, preferably at most 12. As examples of a substituent which $Ra_1$ to $Ra_3$ can have, mention may be made of a hydroxyl group, an alkoxy group, an aryloxy group, a silyl group, a silyloxy group, an alkylthio group, an arylthio group, an amino group, an acylamino group, a sulfonamido group, an alkylamino group, an arylamino group, a carbamoyl group, a sulfamoyl group, a sulfo group, a carboxyl group, a halogen atom, a cyano group, a nitro group, a sulfonyl group, an acyl group, an alkoxycarbonyl group, an aryloxycarbonyl group, an acyloxy group, a hydroxyamino group and a heterocyclic group.

$Ra_1$ and $Ra_3$, or $Ra_2$ and $Ra_3$ may combine with each other to form a 5- to 7-membered ring.

Xa in formula (V-2) represents a heterocyclic group. More specifically, the heterocyclic group is a monovalent group derived from a 5- to 7-membered hetero ring containing at least one nitrogen, sulfur, oxygen or phosphorus atom as a ring-constituting hetero atom, and one of the carbon atoms constituting the ring provides the site for bonding. Examples of such a heterocyclic group include pyridine-2-yl, pyrazinyl, pyrimidinyl, purinyl, quinolyl, imidazolyl, thiazolyl, oxazolyl, 1,2,4-triazole-3-yl, benzimidazole-2-yl, benzothiazolyl, benzoxazolyl, thienyl, furyl, imidazolidinyl, pyrrolinyl, tetrahydrofuryl, 1,3,5-triazine-2-yl, 1,2,4-triazine-3-yl, morpholinyl and phosphinoline-2-yl. $Rb_1$ represents an alkyl, alkenyl or aryl group. These groups have the same meanings as those represented by $Ra_1$ in formula (V-1) respectively.

Y in formula (V-3) represents nonmetal atoms completing a 5-membered ring together with the —N═C— moiety. The group derived from the 5-membered ring formed therein is, e.g., an imidazolyl group, a benzimidazolyl group, a 1,3-thiazole-2-yl group, a 2-imidazoline-2-yl group, a purinyl group or a 3H-indole-2-yl group. Further, Y is constituted of nonmetal atoms completing a 6-membered ring together with the —N═C— moiety, and represents a divalent group whose end attached to the carbon atom of the —N═C— moiety is —N($Rc_1$)—, —C($Rc_2$) ($Rc_3$)—, —C($Rc_4$)═, —O— or —S— (which each is attached to the carbon atom of the —N═C— moiety on the left side). $Rc_1$ to $Rc_4$, which may be the same or different, each represents a hydrogen atom or a substituent (such as an alkyl group, an alkenyl group, an aryl group, an alkoxy group, an aryloxy group, an alkylthio group, an arylthio group, an alkylamino group, an arylamino group, or a halogen atom). Examples of a 6-membered heterocyclic group represented by Y include quinolyl, isoquinolyl, phthalzinyl, quinoxalinyl, 1,3,5-triazine-5-yl and 6H-1,2,5-thiadiazine-6-yl.

In formula (V-2), it is desirable for $Rb_1$ to be an alkyl group or an alkenyl group, especially an alkyl group.

Of the compounds represented by formula (V-2), the compounds represented by the following formula (V-4) are preferred over the others:

(V-4)

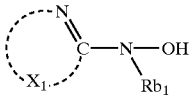

wherein $Rb_1$ has the same meaning as $Rb_1$ in formula (V-2), and $X_1$ has the same meaning as Y in formula (V-3).

The total number of carbon atoms contained in each of the compounds represented by formulae (V-1) to (V-3) is preferably at most 20, particularly preferably at most 12.

Of the compounds represented by formulae (V-1) to (V-3), those represented by formula (V-1) or (V-2) respectively are preferable to those represented by formula (V-3). And the compounds represented by formula (V-1) or (V-4) respectively are much preferable. In particular, the compounds represented by formula ($V-_1$) are advantageous over the others.

Examples of compounds represented by formulae ($V-_1$) to (V-3) respectively are illustrated below, but these examples should not be construes as limiting the scope of the invention.

(V-1-1)

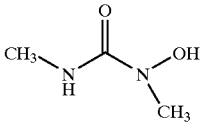

-continued (V-1-2)

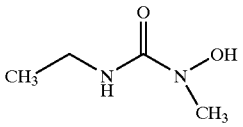

(V-1-3)

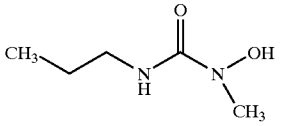

(V-1-4)

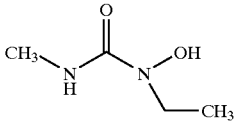

(V-1-5)

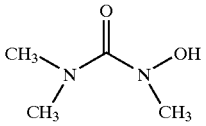

(V-1-6)

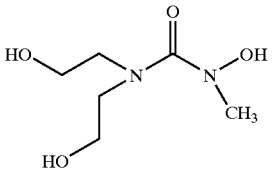

(V-1-7)

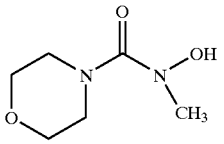

(V-1-8)

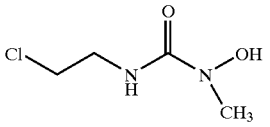

(V-1-9)

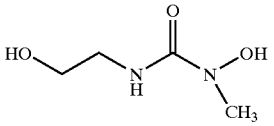

(V-1-10)

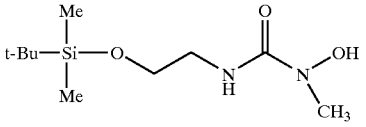

(V-1-11)

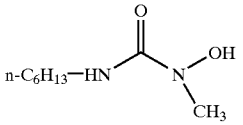

(V-1-12)

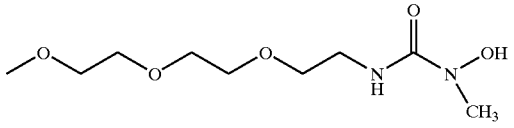

-continued
(V-1-13)
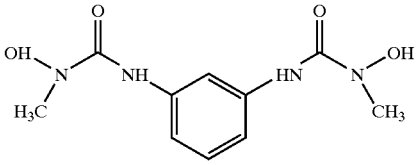
(V-1-14)
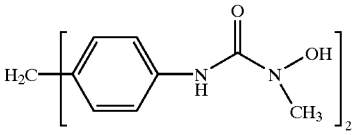
(V-1-15)
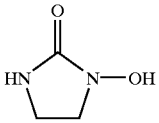
(V-1-16)
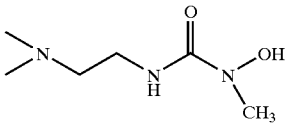
(V-1-17)
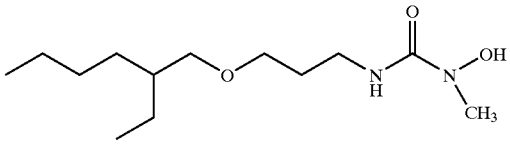
(V-1-18)
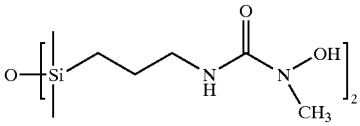
(V-1-19)
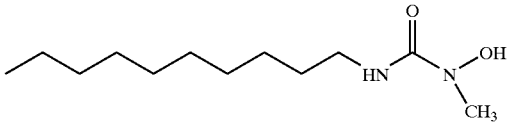
(V-1-20)
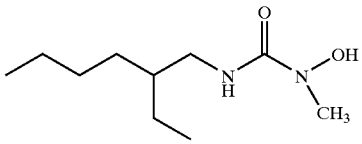
(V-1-21)
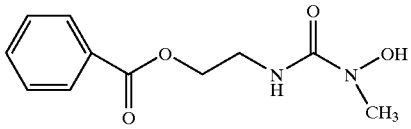
(V-1-22)
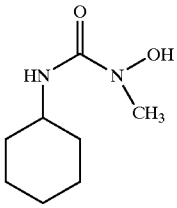
-continued
(V-1-23)
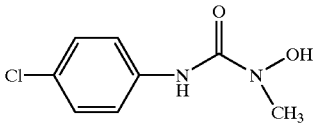
(V-1-24)
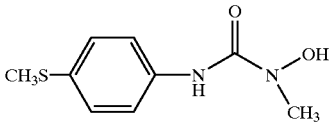
(V-1-25)
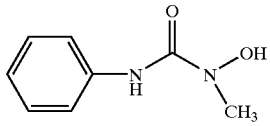
(V-1-26)
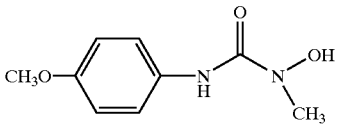
(V-1-27)
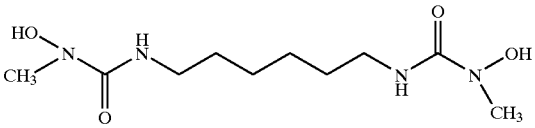
(V-1-28)
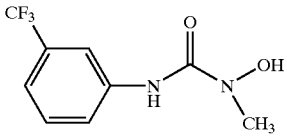
(V-1-29)
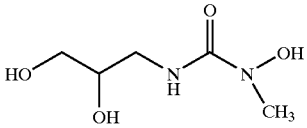
(V-1-30)
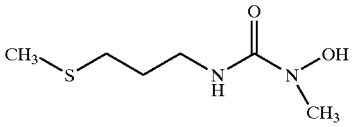
(V-1-31)
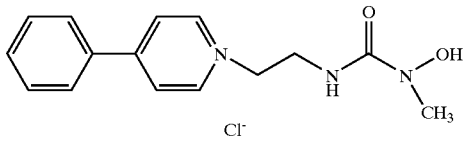
(V-1-32)
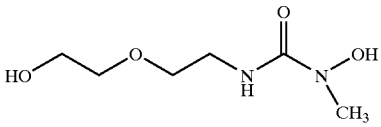
(V-1-33)
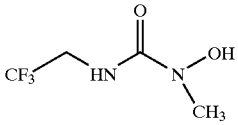

-continued
(V-1-34)
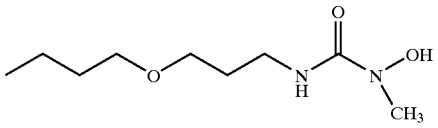
(V-1-35)
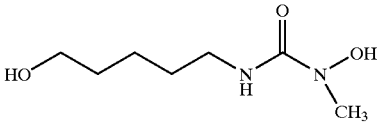
(V-1-36)
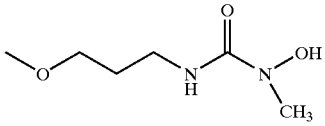
(V-1-37)
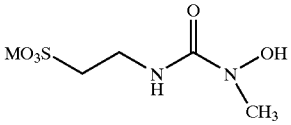
(V-1-38)
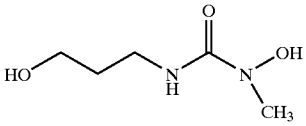
(V-1-39)
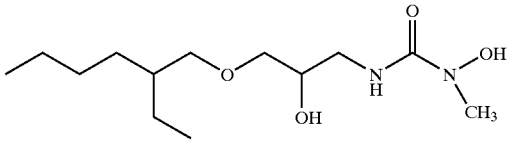
(V-1-40)
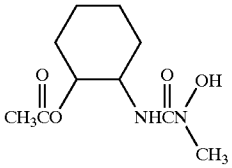
(V-1-41)
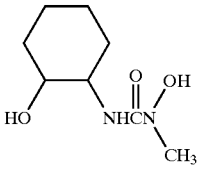
(V-2-1)
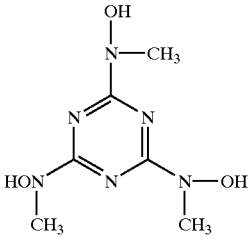
-continued
(V-2-2)
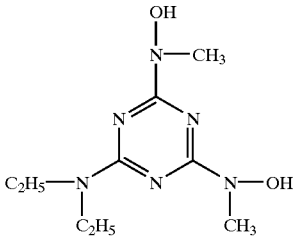
(V-2-3)
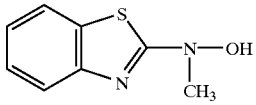
(V-2-4)
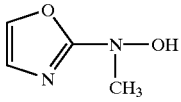
(V-2-5)
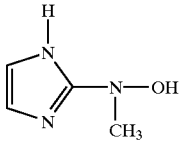
(V-2-6)
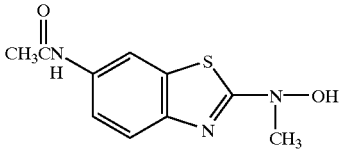
(V-2-7)
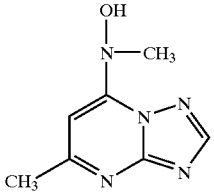
(V-2-8)
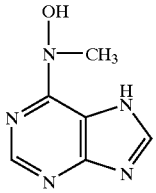
(V-2-9)
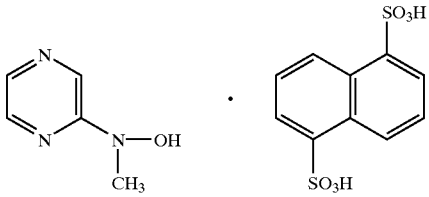
(V-2-10)
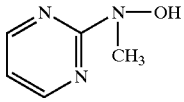

-continued (V-2-11)

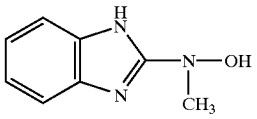

(V-2-12)

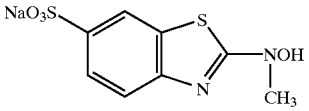

(V-3-1)

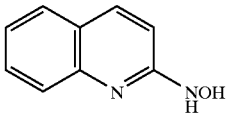

(V-3-2)

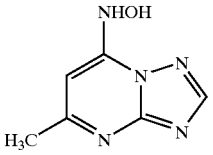

(V-3-3)

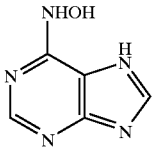

(V-3-4)

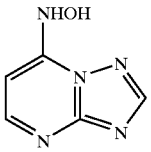

(V-3-5)

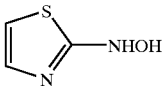

(V-3-6)

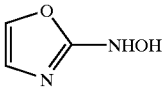

(V-3-7)

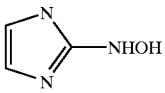

These compounds used in the invention can be easily synthesized using the methods described, e.g., in *J. Org Chem.,* 27, 4054 (1962), *J. Amer. Chem. Soc.,* 73, 2981 (1951) and JP-B-49-10692, or the methods following them.

The present compounds represented by formulae (V-1) to (V-3) may be added as a solution dissolved in water, a water-soluble solvent, such as methanol or ethanol, or a mixture of these solvents, or as an emulsified dispersion. In a case where those compounds are dissolved in water and their solubilities in water can be raised by heightening or lowering the pH, it is favorable to dissolve them in the water adjusted to a high or low pH value respectively and add the resulting solution. On the other hand, those compounds may be dissolved in the presence of a surfactant.

In the invention, it is desirable to add the compounds represented by formulae (V-I) to (V-3) during the process of making emulsions. In this case, the addition may be carried out at any stage of the process. For instance, these compounds can be added to emulsions at the stage of forming silver halide grains, before the desalting stage begins, at the desalting stage, before the chemical ripening starts, at the chemical ripening stage, or before the finished emulsion is prepared. Additionally, the addition of the compound(s) may be portioned out to some different stages. Preferably, those compounds are added before, during or after chemical sensitization. In another way, although the compounds can be added to a coating solution for the emulsion layer, the compounds can be added to a coating solution for a layer adjacent to the emulsion layer or another layer, and thereby dispersed into the emulsion layer at the time the coating solution is applied. In still another way, the emulsified dispersion(s) of those compounds may be mixed with a finished emulsion and then coated in a layer.

The suitable addition amount of the compounds represented by formulae (V-1) to (V-3), though it depends greatly on the addition method adopted and the species of the compounds added, is from $1\times10^{-6}$ to $5\times10^{-2}$ mole, preferably from $1\times10^{-5}$ to $5\times10^{-3}$ mole, per mole of light-sensitive silver halide.

In the invention, the compound represented by formula (III), the compound selected from those represented by formulae (IV-1) and (IV-2) and the compound selected from those represented by formulae (V-1) to (V-3) can be added to the same layer, or they may be added separate layers respectively.

Further, the compounds represented by formula (VI) are illustrated in detail.

In formula (VI), $R_{17}$, $R_{18}$ and $R_{19}$, which are independent of each other, each represents a hydrogen atom, an alkyl group, an alkenyl group, an alkynyl group, an aryl group or a heterocyclic group. $R_{20}$ represents a hydrogen atom, an alkyl group, an alkenyl group, an alkynyl group, an aryl group, a heterocyclic group or $NR_{59}R_{60}$. L represents —CO— or —$SO_2$—, and n represents 0 or 1. $R_{59}$ represents a hydrogen atom, a hydroxyl group, an amino group, an alkyl group, an alkenyl group, an alkynyl group , an aryl group or a heterocyclic group, and $R_{60}$ represents a hydrogen atom, an alkyl group, an alkenyl group, an alkynyl group, an aryl group or a heterocyclic group.

As to the alkyl, alkenyl and alkynyl groups which $R_{17}$, $R_{18}$ and $R_{19}$ each can represent, those containing 1 to 30 carbon atoms are desirable. Particularly preferred ones are 1–10C straight-chain, branched or cyclic alkyl groups, 2–10C alkenyl groups and 2–10C alkynyl groups, with examples including methyl, ethyl, propyl, cyclopropyl, allyl, propargyl and benzyl groups. Suitable examples of an aryl group represented by $R_{17}$, $R_{18}$ and $R_{19}$ each includes those containing 6 to 30 carbon atoms, preferably 6–12C monocyclic or condensed-ring aryl groups, such as phenyl and naphthyl groups. The heterocyclic groups which $R_{17}$, $R_{18}$ and $R_{19}$ can represent are 3- to 10-membered saturated or unsaturated heterocyclic groups containing at least one nitrogen, oxygen or sulfur atom as a hetero atom. These groups may be monocyclic, or they may form condensed rings by being fused together with other aromatic rings. Preferably, the heterocyclic groups are 5- or 6-membered aromatic heterocyclic groups, such as pyridyl, imidazolyl, quinolyl, benzimidazolyl, pyrimidyl, pyrazolyl, isoquinolyl, thiazolyl, thienyl, furyl and benzothiazolyl.

The alkyl, alkenyl, alkynyl, aryl and heterocyclic groups which $R_{20}$ can represent have the same meanings as those which $R_{17}$, $R_{18}$ and $R_{19}$ each can represent. The alkyl, alkenyl, alkynyl, aryl and heterocyclic groups which $R_{59}$ and $R_{60}$ each can represent in the $NR_{59}R_{60}$ group as $R_{20}$ have the same meanings as those which $R_{17}$, $R_{18}$ and $R_{19}$ each can represent, too.

Each of the groups represented by $R_{17}$, $R_{18}$, $R_{19}$, $R_{20}$, $R_{59}$ and $R_{60}$ may be substituted by the substituent Y recited hereinbefore.

In formula (VI), $R_{17}$ and $R_{18}$, $R_{17}$ and $R_{19}$, $R_{19}$ and $R_{20}$, or $R_{20}$ and $R_{18}$ may combine with each other to complete a ring.

When n is 0 in formula (VI), the desirable $R_{17}$, $R_{18}$ and $R_{19}$ include 1–10C alkyl groups, 2–10C alkenyl groups, 2–10C alkynyl groups, 6–10C aryl groups and nitrogen-containing heterocyclic groups, and the desirable $R_{20}$ includes a hydrogen atom, 1–10C alkyl groups, 2–10C alkenyl groups, 2–10C alkynyl groups, 6–10C aryl groups and nitrogen-containing heterocyclic groups. Preferably, $R_{17}$, $R_{18}$ and $R_{19}$ each is a group selected from 1–10C alkyl groups, 2–10C alkenyl groups, 2–10C alkynyl groups, 6–10C aryl groups or nitrogen-containing heterocyclic groups, and $R_{20}$ is a hydrogen atom.

When n is 1 in formula (VI), the desirable $R_{17}$, $R_{18}$ and $R_{19}$ include a hydrogen atom, 1–10C alkyl groups, 2–10C alkenyl groups, 2–10C alkynyl groups, 6–10C aryl groups and nitrogen-containing heterocyclic groups, the desirable $L_1$ is —CO—, and the desirable $R_{20}$ includes a hydrogen atom, 1–10C alkyl groups, 2–10C alkenyl groups, 2–10C alkynyl groups, 6–10C aryl groups, nitrogen-containing heterocyclic groups and $NR_{59}R_{60}$. Therein, $R_{59}$ is preferably a hydrogen atom, a hydroxyl group, an amino group, a 1–10C alkyl group, a 2–10C alkenyl group, a 2–10C alkynyl group, a 6–10C aryl group or a nitrogen-containing heterocyclic group, while $R_{60}$ is preferably a hydrogen atom, a 1–10C alkyl group, a 2–10C alkenyl group, an alkynyl group, 6–10C aryl group or a heterocyclic group. In particular, it is advantageous that $R_{17}$ be a 6–10C aryl group, both $R_{18}$ and $R_{19}$ be hydrogen atoms, $L_1$ be —CO—, $R_{20}$ be $NR_{59}R_{60}$ and $R_{59}$ be a hydrogen atom, a hydroxyl group, a 1–10C alkyl group, an alkenyl group or an alkynyl group.

Examples of a compound represented by formula (VI) are illustrated below, but these examples should not be construed as limiting the scope of the invention.

(VI-1)

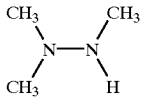

(VI-2)

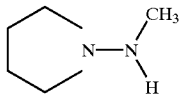

(VI-3)

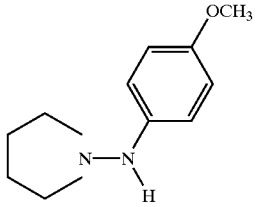

(VI-4)

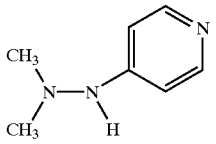

-continued (VI-5)

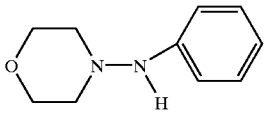

(VI-6)

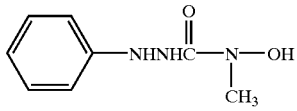

(VI-7)

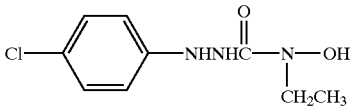

(VI-8)

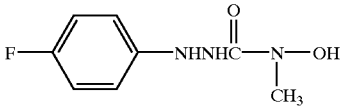

(VI-9)

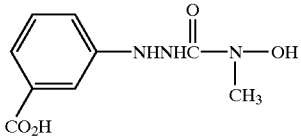

(VI-10)

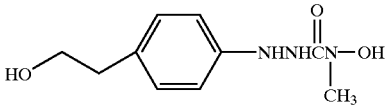

(VI-11)

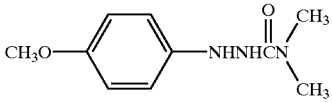

(VI-12)

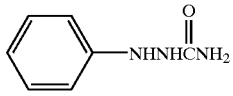

(VI-13)

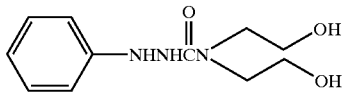

(VI-14)

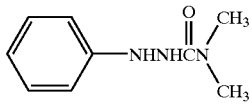

The compounds represented by formula (VI) are available with each as commercial chemicals, or can be synthesized from commercial chemicals by the use of known methods. For syntheses of the compounds represented by formula (VI) can be adopted the methods described, e.g., in *J. Amer. Chem. Soc.*, vol. 72, p. 2762 (1950), *Organic Synthesis*, vol. 2, p. 395, and Shin Jikken Kagaku Koza, vol. 14-2 and 14-3, Maruzen, Tokyo (1977), or the methods following them.

It is desirable that the compounds represented by formula (VI) be added to a layer adjacent to or other than an emulsion layer by incorporating them in a coating composition for forming such a layer before or at the time when the coating composition is coated, and then allowed to be dispersed into the emulsion layer. However, they may be added to an emulsion during the emulsion-making, specifically before, during or after chemical sensitization.

The appropriate addition amount of those compounds, though it depends largely on the addition method adopted and the species of the compound(s) added, is generally from $5\times10^{-6}$ to 0.05 mole, preferably from $1\times10^{-5}$ to 0.005 mole, per mole of light-sensitive silver halide. When the amount added is greater than the foregoing upper limit, undesirable results, including an increase in fog, are produced.

In adding the compounds represented by formula (VI), it is desirable that they be dissolved in a solvent soluble in water. The pH of their solutions may be lowered or heightened by adding thereto an acid or a base. On the other hand, the surfactants may be present therein. Those compounds may be dissolved in high boiling organic solvents and added as emulsified dispersions, or they may be made into microcrystalline dispersions according to known methods and then added.

The compounds represented by formula (VI) may be used as a mixture of two or more thereof. When they are used as a mixture of two or more thereof, they may be added to the same layer or separate layers.

With respect to the ranking of the compounds represented by formulae (II) to (VI), the following is the descending order of suitability for the invention:

(V-1)>(V-2)>(V-3)>(VI)>(II)>(III)>(IV-1)>(IV-2)

The silver halide emulsions usable in the present photographic light-sensitive material include high chloride-content silver halide emulsions and silver iodobromide emulsions. In particular, (111) AgBrI tabular emulsions (iodide content: 1–20 mole %) are preferred over the others.

The suitable grain size and thickness of the tabular emulsions are from 0.2 to 5 $\mu$m (equivalent-circle diameter) and from 0.01 to 0.1 $\mu$m respectively. The appropriate variation coefficients of grain size distribution and grain thickness distribution are each at most 20%, preferably from 10 to 15% And the suitable aspect ratio is from 3 to 30.

The tabular silver iodobromide emulsions suitable for the invention can be made by reference to U.S. Pat. Nos. 4,439,520, 4,434,226, 4,433,048, 4,414,310 and 5,334,495.

And the very thin tabular emulsions having a grain thickness of at most 0.1 $\mu$m can be made by reference to U.S. Pat. Nos. 5,460,928, 5,411,853 and 5,418,125.

The high chloride-content tabular silver halide emulsions suitable for the invention can be prepared by reference to European Patent Nos. 723,187, 619,517, 534,395 and 584,644.

For details of the color couplers used in the invention, the description in JP-A-11-65007, paragraph Nos. 0019 to 0024, can be referred to. For details of the chemical sensitization applicable to the invention, the description in the above gazette, paragraph Nos. 0041 to 0053, can be referred to. For details of the antifoggants usable in the invention, the description in the above gazette, paragraph No. 0057, can be referred to. For details of the sensitizing dyes usable in the invention, the description in the above gazette, paragraph Nos. 0058 to 0060, can be referred to. For details of the photographic development processing applicable to the invention, the description in the above gazette, paragraph Nos. 0080 to 0099, can be referred to. For details of the APS system application to the invention, the description in the above gazette, paragraph Nos. 0100 to0126, can be referred to.

Now, the present invention will be illustrated in greater detail by reference to the following examples. However, the invention should not be construed as being limited to these examples.

EXAMPLE 1

(1) Preparation of Emulsion

A solution containing 7.0 g of gelatin having an average molecular weight of 15,000 and 4.5 g of KBr in 1,200 ml of water was kept at 30° C. with stirring, and thereto a 1.9M aqueous solution of $AgNO_3$ and a 1.9 M aqueous solution of KBr were added at a rate of 25 ml/min over a period of 70 seconds in accordance with a double jet method to form tabular-grain nuclei. A 400 ml portion of the emulsion thus obtained was set aside for seed crystals, and thereto 650 ml of an inert gelatin solution (containing 20 g of gelatin and 1.2 g of KBr) was added. The resulting emulsion was heated up to 75° C., and ripened for 40 minutes. Thereto, an aqueous solution containing 1.7 g of $AgNO_3$ was further added over a period of 90 seconds, followed by addition of 7.0 ml of a 50 weight % aqueous solution of $NH_4NO_3$ and 7.0 ml of a 25 weight % of $NH_3$. The resultant emulsion was further ripened for 40 minutes.

The ripened emulsion was adjusted to pH 7 by the addition of 3N $HNO_3$, and thereto 1.0 g of KBr was added. Subsequently thereto, a pair of 366.5 ml of a 1.9M aqueous solution of $AgNO_3$ and an aqueous solution of KBr, a pair of 53.6 ml of a 1.9M aqueous solution of $AgNO_3$ and an aqueous KBr solution containing 33.3 mole % of KI, and a pair of 160.5 ml of a 1.9M aqueous solution of $AgNO_3$ and an aqueous solution of KBr were added in succession as the pAg was kept at 7.9. Thus, Emulsion 1 was made.

The grains comprised in Emulsion 1 had a triple structure containing the highest iodide content area in the intermediate shell, the average aspect ratio thereof was 2.8, the variation coefficient of grain size distribution was 7%, and the average grain size was 0.98 $\mu$m on an equivalent-sphere diameter basis.

Subsequently, the Emulsion 1 was chemically sensistized to the optimum by adding thereto the sensitizing dye illustrated below, potassium thiocyanate, chloroauric acid, sodium thiosulfate, N,N-dimethylselenourea and the present Compounds (III-1) and (V-2-12) in succession, and further thereto the following water-soluble mercapto compounds MER-1 and MER-2 were added in a ratio of 4:1 so that the total amount added was $3.6\times10^{-4}$ mole per mole of silver halide to complete the chemical sensitization. Additionally, the optimal chemical sensitization was achieved when the amount of the sensitizing dye illustrated below added was $4.00\times10^{-4}$ mole per mole of silver.

S-1

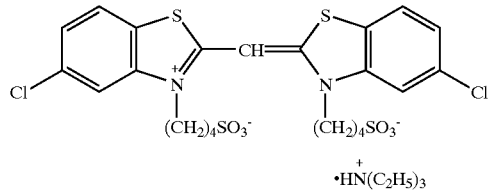

S-2

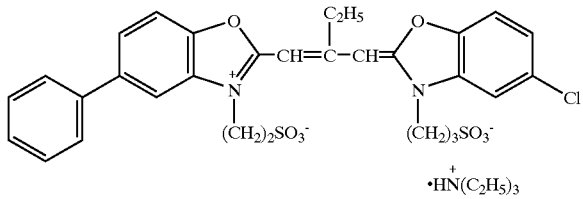

-continued

S-3

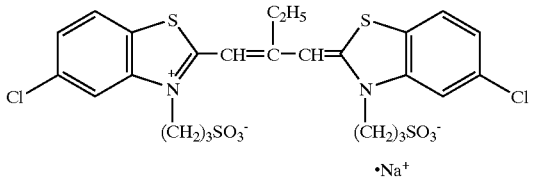

•$Na^+$

Compound MER-1

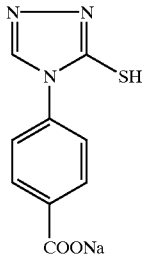

Compound MER-2

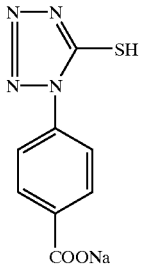

(2) Preparation of Coated Samples

On a cellulose triacetate film support provided with a subbing layer, the emulsion prepared above and the emulsions modified as shown in Table 2 were each coated under the coating conditions shown in the following Table 1, thereby preparing Samples Nos. 101 to 115.

TABLE 1

| Emulsion Coating Conditions | |
|---|---|
| (1) Emulsion Layer | |
| Emulsion shown in Table 2 | $1 \times 10^{-2}$ mole/$m^2$ |
| Coupler | $1.5 \times 10^{-3}$ mole/$m^2$ |
| 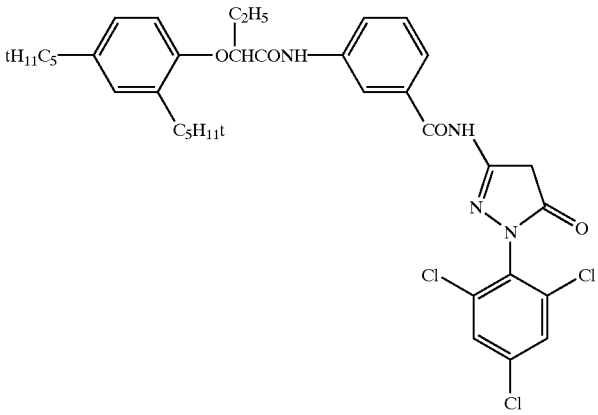 | |
| Tricresyl phosphate | 1.10 g/$m^2$ |
| Gelatin | 2.30 g/$m^2$ |
| (2) Protective Layer | |
| Sodium 2,4-dichloro-6-hydroxy-s-triazine | 0.08 g/$m^2$ |
| Gelatin | 1.80 g/$m^2$ |

Each of these Samples was subjected to exposure for sensitometry (1/100 sec.), and then to the color photographic development processing described below.

Processing Process

| Step | Processing time | Processing temp. | Replenisher volume | Tank volume |
|---|---|---|---|---|
| Color development | 2 min. 45 sec. | 38° C. | 33 ml | 20 l |
| Bleaching | 6 min. 30 sec; | 38° C. | 25 ml | 40 l |
| Washing | 2 min. 10 sec. | 24° C. | 1,200 ml | 20 l |
| Fixing | 4 min. 20 sec. | 38° C. | 25 ml | 30 l |
| Washing (1) | 1 min. 05 sec. | 24° C. | counter-current pipe laying system from (2) to (1) | 10 l |
| Washing (2) | 1 min. 00 sec. | 24° C. | 1,200 ml | 10 l |
| Stabilization | 1 min. 05 sec. | 38° C. | 25 ml | 10 l |
| Drying | 4 min. 20 sec. | 55° C. | | |

Each of the replenisher volumes shown above is per processed area 35 mm wide and 1 m long.

The compositions of the processing solutions used in the foregoing steps are as follows:

| | Mother liquor | Replenisher |
|---|---|---|
| (Color developer) | | |
| Diethylenetriaminepentaacetic acid | 1.0 g | 1.1 g |
| 1-Hydroxyethylidene-1,1-diphosphonic acid | 3.0 g | 3.2 g |
| Sodium sulfite | 4.0 g | 4.4 g |
| Potassium carbonate | 30.0 g | 37.0 g |
| Potassium bromide | 1.4 g | 0.7 g |
| Potassium iodide | 1.5 mg | — |

-continued

| | Mother liquor | Replenisher |
|---|---|---|
| Hydroxylamine sulfate | 2.4 g | 2.8 g |
| 4-[N-Ethyl-N-β-hydroxyethylamino]-2-methylaniline sulfate | 4.5 g | 5.5 g |
| Water to make | 1.0 l | 1.0 l |
| pH adjusted to | 10.05 | 10.05 |
| (Bleaching Solution) | | |
| Sodium ethylenediaminetetraacetato ferrate (III) trihydrate | 100.0 g | 120.0 g |
| Disodium ethylene diaminetetraacetate | 10.0 g | 11.0 g |
| Ammonium bromide | 140.0 g | 160.0 g |
| Ammonium nitrate | 30.0 g | 35.0 g |
| Aqueous ammonia (27%) | 6.5 ml | 4.0 ml |
| Water to make | 1.0 l | 1.0 l |
| pH adjusted to | 6.0 | 5.7 |
| (Fixing Solution) | | |
| Sodium ethylenediaminetetraacetate | 0.5 g | 0.7 g |
| Sodium sulfite | 7.0 g | 8.0 g |
| Sodium hydrogensulfite | 5.0 g | 5.5 g |
| Aqueous ammonium thiosulfate solution (70%) | 170 ml | 200 ml |
| Water to make | 1.0 l | 1.0 l |
| pH adjusted to | 6.7 | 6.6 |
| (Stabilizing Solution) | | |
| Formaldehyde (37%) | 2.0 ml | 3.0 ml |
| Polyoxyethylene-p-monononylphenyl ether (average polymerization degree: 10) | 0.3 g | 0.45 g |
| Disodium ethylenediaminetetraacetate | 0.05 g | 0.08 g |
| Water to make | 1.0 l | 1.0 l |
| pH adjusted to | 5.8–8.0 | 5.8–8.0 |

Density measurements of the processed samples were made via a green filter, and thereby the fresh sensitivity and fog were evaluated. Therein, the sensitivity was defined as the reciprocal of the exposure amount providing a density higher than the fog density by 0.2. The fresh sensitivities set forth in Table 2 are shown as relative values, with Sample No. 101 being taken as 100. On the other hand, the storage fog was defined as the degree of fog generating in each sample upon exposure to combustion gas (the exhaust gas from a gasoline car was used in Examples), and evaluated in the following way.

The internal-combustion engine, E-S14 (made by Nissan Motor Co., Ltd.), filled with regular gasoline (a product of Showa Shell Oil Co., Ltd.) was brought into being in an idling state (the engine speed: 1000 r.p.m.), and the combustion gas emitted from the exhaust pipe exit was withdrawn as it was. Then the collected exhaust gas was controlled so as to have the pressure of 1 atm. and the relative humidity of 60% at 25° C. All the unexposed Sample Nos. 101 to 115 was allowed to stand for 5 days in the container filled with the foregoing controlled exhaust gas, and thereafter they underwent the same exposure and photographic development processing operations as described above, followed by fog density measurements via the green filter. Thus, each sample was examined for an increment in fog density due to exposure to the exhaust gas. These increments thus determined were compared with one another.

The emulsion (the compound(s) incorporated therein) and the methine compound (as a sensitizing dye) used in each sample and the results of sensitivity and fog measurements are shown in Table 2.

TABLE 2

| Sample No. | Compound added | Amount added*) | Sensitizing dye**) | Fresh sensitivity | fog | Increment in fog due to exhaust gas | note |
|---|---|---|---|---|---|---|---|
| 101 | — | — | S-1 | 100 | 0.28 | 0.46 | compar. |
| 102 | I-2 | $1.0 \times 10^{-4}$ | S-1 | 196 | 0.39 | 0.51 | compar. |
| 103 | III-1 | $1.0 \times 10^{-4}$ | S-1 | 99 | 0.09 | 0.08 | compar. |
| | V-2-12 | $2.5 \times 10^{-4}$ | | | | | |
| 104 | I-2 | $1.0 \times 10^{-4}$ | S-1 | 186 | 0.20 | 0.17 | invention |
| | III-1 | $1.0 \times 10^{-4}$ | | | | | |
| 105 | I-2 | $1.0 \times 10^{-4}$ | S-1 | 195 | 0.18 | 0.18 | invention |
| | V-2-12 | $2.5 \times 10^{-4}$ | | | | | |
| 106 | I-2 | $0.5 \times 10^{-4}$ | S-1 | 188 | 0.16 | 0.06 | invention |
| | III-1 | $1.0 \times 10^{-4}$ | | | | | |
| | V-2-12 | $2.5 \times 10^{-4}$ | | | | | |
| 107 | I-2 | $1.0 \times 10^{-4}$ | S-1 | 211 | 0.16 | 0.10 | invention |
| | III-1 | $1.0 \times 10^{-4}$ | | | | | |
| | V-2-12 | $2.5 \times 10^{-4}$ | | | | | |
| 108 | I-2 | $1.5 \times 10^{-4}$ | S-1 | 212 | 0.15 | 0.11 | invention |
| | III-1 | $1.0 \times 10^{-4}$ | | | | | |
| | V-2-12 | $2.5 \times 10^{-4}$ | | | | | |
| 109 | — | — | S-2 | 102 | 0.29 | 0.50 | compar. |
| 110 | I-2 | $1.0 \times 10^{-4}$ | S-2 | 220 | 0.17 | 0.10 | invention |
| | III-1 | $1.0 \times 10^{-4}$ | | | | | |
| | V-2-12 | $2.5 \times 10^{-4}$ | | | | | |
| 111 | I-3 | $1.0 \times 10^{-4}$ | S-2 | 219 | 0.18 | 0.09 | invention |
| | III-1 | $1.0 \times 10^{-4}$ | | | | | |
| | V-2-12 | $2.5 \times 10^{-4}$ | | | | | |
| 112 | I-4 | $1.0 \times 10^{-4}$ | S-2 | 223 | 0.17 | 0.13 | invention |
| | III-1 | $1.0 \times 10^{-4}$ | | | | | |
| | V-2-12 | $2.5 \times 10^{-4}$ | | | | | |
| 113 | I-6 | $1.0 \times 10^{-4}$ | S-2 | 199 | 0.16 | 0.10 | invention |
| | III-1 | $1.0 \times 10^{-4}$ | | | | | |
| | V-2-12 | $2.5 \times 10^{-4}$ | | | | | |
| 114 | — | — | S-3 | 89 | 0.34 | 0.55 | compar. |
| 115 | I-2 | $1.0 \times 10^{-4}$ | S-3 | 199 | 0.15 | 0.12 | invention |
| | III-1 | $1.0 \times 10^{-4}$ | | | | | |
| | V-2-12 | $2.5 \times 10^{-4}$ | | | | | |
| 116 | I-3 | $1.0 \times 10^{-4}$ | S-3 | 200 | 0.16 | 0.10 | invention |
| | III-1 | $1.0 \times 10^{-4}$ | | | | | |
| | V-2-12 | $2.5 \times 10^{-4}$ | | | | | |
| 117 | I-8 | $1.0 \times 10^{-4}$ | S-3 | 198 | 0.18 | 0.09 | invention |
| | III-1 | $1.0 \times 10^{-4}$ | | | | | |
| | V-2-12 | $2.5 \times 10^{-4}$ | | | | | |
| 118 | — | — | — | 50 | 0.26 | 0.33 | compar. |
| 119 | I-2 | $1.0 \times 10^{-4}$ | — | 76 | 0.18 | 0.11 | invention |
| | III-1 | $1.0 \times 10^{-4}$ | | | | | |
| | V-2-12 | $2.5 \times 10^{-4}$ | | | | | |

*)mole/mole Ag
**)$4 \times 10^{-4}$ mole/mole Ag

As can be seen from Table 2, the combined use of the present compounds in the photographic light-sensitive material enabled high resistance to automobile exhaust gas, great reduction in the fog caused by sensitivity increase, and high fresh sensitivity, as compared with the use of the comparative compound.

EXAMPLE 2

A tabular silver iodobromide emulsion (referred to as "Emulsion 2") was prepared in the same manner as Emulsion D in Example 5 of JP-A-8-29904.

A multi-layer color photographic material was prepared in the same manner as Sample 101 in Example 5 of JP-A-8-29904, except that the Emulsion D in the fifth layer was replaced by Emulsion 2 and the sensitizing dyes Exs-1, 2 and 3 were replaced by the sensitizing dye (S-3) ($5.0 \times 10^{-4}$ mole/mole Ag) or the combination of the sensitizing dye (S-3) ($5.0 \times 10^{-4}$ mole/mole Ag) with the present compound (I-1) ($5.0 \times 10^{-4}$ mole/mole Ag). The thus prepared photographic materials were named Sample No. 201 and Sample No. 202. The sensitivities of these samples were examined by carrying out 1/100 sec. exposure via an optical wedge and a red filter by means of Fuji FW model Sensitometer (made by Fuji Photo Film Co., Ltd.) and the color photographic development processing operation using the same processing steps and processing solutions as in Example 1 of JP-A-8-29904, and then making cyan density measurements. The standard point of the density to determine the sensitivity was fog +0.2. The sensitivities are expressed as relative values, with Sample No. 201 being taken as 100. The Sample No. 202 according to the invention showed high sensitivity, compared with comparative Sample No. 201.

In accordance with the invention, there can be obtained silver halide photographic materials having high sensitivity, only a moderate increase in fog even when they are allowed to stand under severe conditions, such as high temperature, high humidity and exposure to harmful gas generating upon combustion like an automobile exhaust gas, and reduced fog in spite of their increased sensitivities.

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive material having at least one emulsion layer comprising silver halide grains, said emulsion layer further comprising at least one compound represented by the following formula (I) and at least one compound represented by the following formula (II), (III), (IV-2), (V-1), (V-2), (V-3) or (VI):

$$(X)_l\text{—}(L)_m\text{—}(A\text{—}B)_n \qquad \text{(I)}$$

wherein X represents a silver halide adsorbing group containing at least one N, S, P, Se or Te atom, or a light absorbing group; L represents a divalent linkage group comprising at least one C, N, S or O atom; A represents an electron donating group; B represents a releasing group; l and m each represents 0, 1, 2 or 3; and n represents 1 or 2;

(II)

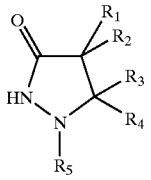

wherein $R_1$, $R_2$, $R_3$ and $R_4$, which are independent of each other, each represents a hydrogen atom, an aryl group, a chain or cyclic alkyl group, a chain or cyclic alkenyl group, or an alkynyl group; and $R_5$ represents a chain or cyclic alkyl group, a chain or cyclic alkenyl group, an alkynyl group, an aryl group or a heterocyclic group;

$$(Het)_{k1}\text{—}[(Q_1)_{k2}\text{—}(Hy)]_{k3} \qquad \text{(III)}$$

wherein Het represents a group enabling the adsorption to silver halide grains; $Q_1$ represents a divalent linkage group made up of an atom or an atomic group comprising at least one carbon, nitrogen, sulfur or oxygen atom; Hy represents a group having a hydrazine structure represented by $R_6R_7N\text{—}NR_8R_9$; $R_6$, $R_7$, $R_8$ and $R_9$, which are independent of each other, each represents an alkyl group, an alkenyl group, an alkynyl group, an aryl group or a heterocyclic group, or $R_6$ and $R_7$, $R_8$ and $R_9$, $R_6$ and $R_8$, or $R_7$ and $R_9$ may combine with each other to complete a ring, provided that at least one among $R_6$, $R_7$, $R_8$ and $R_9$ is an alkylene group, an alkenylene group, an alkynylene group, an arylene group or a divalent heterocyclic ring residue to which $\text{—}(Q_1)_{k2}(Het)_{k1}$ is attached; k1 and k3 each represents 1, 2, 3 or 4; and k2 represents 0 or 1;

(IV-2)

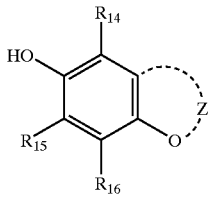

wherein $R_{14}$, $R_{15}$ and $R_{16}$, which are independent of each other, each represents a hydrogen atom or a substituent group; and Z represents nonmetal atoms completing a 4- to 6-membered ring;

(V-1)

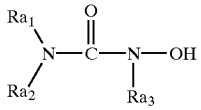

(V-2)

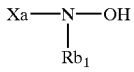

(V-3)

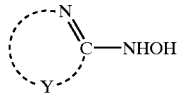

wherein $Ra_1$ represents a substituted or unsubstituted alkyl group, an alkenyl group or an aryl group, $Ra_2$ represents a hydrogen atom or a group represented by $Ra_1$, and $Ra_3$ represents a hydrogen atom, a substituted or unsubstituted alkyl group containing 1 to 10 carbon atoms or a substituted or unsubstituted alkenyl group containing 1 to 10 carbon atoms, or any two of $Ra_1$, $Ra_2$ and $Ra_3$ combine with each other to complete a 5- to 7-membered ring; Xa represents a heterocyclic group and $Rb_1$ represents an alkyl group, an alkenyl group or an aryl group, or Xa and $Rb_1$ combine with each other to complete a 5- to 7-membered ring; Y represents nonmetal atoms forming a 5-membered ring in combination with the —N═C— moiety, or nonmetal atoms forming a 6-membered ring in combination with the —N═C— moiety wherein the end group of Y bonded to the carbon atom of the —N═C— moiety is a group selected from the class consisting of $\text{—}N(Rc_1)\text{—}$, $\text{—}C(Rc_2)(Rc_3)\text{—}$, $\text{—}C(Rc_4)\text{═}$, —O— and —S— which are each bonded to the carbon atom of —N═C— on the left side; and $Rc_1$ to $Rc_4$, which are independent of each other, each represents a hydrogen atom or a substituent group;

(VI)

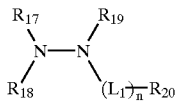

wherein $R_{17}$, $R_{18}$ and $R_{19}$, which are independent of each other, each represents a hydrogen atom, an alkyl group, an alkenyl group, an aryl group or a heterocyclic group, $R_{20}$ represents a hydrogen atom, an alkyl group, an alkenyl group, an alkynyl group, an aryl group, a heterocyclic group or —$NR_{21}R_{22}$, $L_1$ represents —CO— or —$SO_2$—, n represents 0 or 1, $R_{21}$ represents a hydrogen atom, a hydroxyl group, an amino group, an alkyl group, an alkenyl group, an alkynyl group, an aromatic group or a heterocyclic group, $R_{22}$ represents an alkyl group, an alkenyl group, an alkynyl group, an aromatic group or a heterocyclic group, or $R_{17}$ and $R_{18}$, $R_{17}$ and $R_{19}$, $R_{19}$ and $R_{20}$, or $R_{20}$ and $R_{18}$ combine with each other to complete a ring.

2. A silver halide photographic light-sensitive material as claimed in claim 1, wherein the silver halide grains are sensitized by a compound represented by formula (I).

3. A silver halide photographic light-sensitive material as claimed in claim 1, wherein the compound represented by formula (I) has an oxidation potential of from 0 to 1.5 V.

4. A silver halide photographic light-sensitive material as claimed in claim 1, wherein the A—B moiety in the compound represented by formula (I), when it takes an oxidation form, undergoes bond cleavage reaction to produce a radical A. having an oxidation potential of –0.6 V or below and a releasing fragment B.

5. A silver halide photographic light-sensitive material as claimed in claim 1, at least 60% of said silver halide grains in said at least one emulsion layer on a projected area basis being tabular silver halide grains having an aspect ratio of at least 8.

6. The silver halide photographic light-sensitive material as claimed in claim 1, wherein said at least one compound represented by the following formula (II), (III), (IV-2), (V-1), (V-2), (V-3) or (VI) is at least one compound represented by formula (II).

7. The silver halide photographic light-sensitive material as claimed in claim 1, wherein said at least one compound represented by the following formula (II), (III), (IV-2), (V-1), (V-2), (V-3) or (VI) is at least one compound represented by formula (III).

8. The silver halide photographic light-sensitive material as claimed in claim 1, wherein said at least one compound represented by the following formula (II), (III), (IV-2), (V-1), (V-2), (V-3) or (VI) is at least one compound represented by formula (IV-2).

9. The silver halide photographic light-sensitive material as claimed in claim 1, wherein said at least one compound represented by the following formula (II), (III), (IV-2), (V-1), (V-2), (V-3) or (VI) is at least one compound represented by formula (V-1).

10. The silver halide photographic light-sensitive material as claimed in claim 1, wherein said at least one compound represented by the following formula (II), (III), (IV-2), (V-1), (V-2), (V-3) or (VI) is at least one compound represented by formula (V-2).

11. The silver halide photographic light-sensitive material as claimed in claim 1, wherein said at least one compound represented by the following formula (II), (III), (IV-2), (V-1), (V-2), (V-3) or (VI) is at least one compound represented by formula (V-3).

12. The silver halide photographic light-sensitive material as claimed in claim 1, wherein said at least one compound represented by the following formula (II), (III), (IV-2), (V-1), (V-2), (V-3) or (VI) is at least one compound represented by formula (VI).

* * * * *